US005566934A

United States Patent [19]

Black et al.

[11] Patent Number: 5,566,934

[45] Date of Patent: Oct. 22, 1996

[54] BASEBALL TRAINER

[75] Inventors: Wesley F. Black; Charles D. Black, both of Williston, N. Dak.

[73] Assignee: Stringliner Company, Williston, N. Dak.

[21] Appl. No.: 261,493

[22] Filed: Jun. 17, 1994

[51] Int. Cl.[6] ..... A63B 69/40

[52] U.S. Cl. ..... 273/26 A

[58] Field of Search ..... 273/26 D, 26 R, 273/29 A, 176 R, 176 FA

[56] References Cited

U.S. PATENT DOCUMENTS

| | | | |
|---|---|---|---|
| 3,157,399 | 11/1964 | Gaudet | 273/26 A |
| 3,194,556 | 7/1965 | Vinson | 273/26 A |
| 3,778,064 | 12/1973 | Nutter | 273/176 FA |
| 4,177,994 | 12/1979 | Lindquist | 273/176 FA |
| 4,199,141 | 4/1980 | Garcia | 273/26 A |
| 4,269,162 | 5/1981 | Abraham et al. | 124/7 |
| 4,524,749 | 6/1985 | Giovagnoli | 124/7 |
| 4,657,250 | 4/1987 | Newland | 273/26 A |
| 4,861,027 | 8/1989 | Thaxton | 273/29 A |
| 4,995,371 | 2/1991 | Kuizinas | 124/7 |
| 5,024,411 | 6/1991 | Rousseau | 273/176 R |
| 5,046,729 | 9/1991 | Yancey | 273/26 A |
| 5,121,735 | 6/1992 | Hancock | 124/7 |
| 5,163,014 | 11/1992 | Calimeri | 364/565 |
| 5,222,731 | 6/1993 | Hanabusa | 273/26 A |
| 5,230,505 | 7/1993 | Paquet | 273/26 A |
| 5,333,855 | 8/1994 | Silin | 273/26 A |
| 5,419,549 | 5/1995 | Galloway | 273/26 A |

*Primary Examiner*—Theatrice Brown

*Attorney, Agent, or Firm*—Robert G. Crouch; Chrisman Bynum & Johnson

[57] ABSTRACT

A baseball trainer includes a target apparatus set at a predetermined distance from a practicing ballplayer. The target apparatus includes a plurality of panels for indicating a "strike" or a "ball" which indication is communicated to a microcomputer in a console adjacent to the practicing player. The target apparatus is associated with an adjacent catching apparatus and ball return apparatus for returning the ball to the player. The player pitches from a pitching rubber which includes a switch for providing a start signal when the player shifts the weight off of his back foot at the instant the ball is pitched toward the target apparatus. The start time, together with a stop time generated by the "strike" or "ball" panels, can be used by the microcomputer to generate an elapsed time which together with the known distance is used to calculate the speed of the pitch and which is then audibly reported to the practicing player. Alternatively, the trainer can be used without a pitching rubber in a fielding mode wherein a start signal is generated when the ball return apparatus propels the ball toward the practicing player. The player then catches the ball and throws it back to the target apparatus and a fielding time is calculated.

59 Claims, 15 Drawing Sheets

| | |
|---|---|
| Training | Ptch Dist 46 |
| ▷ Pitching | Fld Time 5s |
| Infield | No. Plyrs 2 |
| Outfield | Vol ▯▯▯▯▯▯▯▯▯▯ |

FIG. 10a

[TRADEMARK]
TARGET POWER IS ON press <ON> to begin

FIG. 10b

[TRADEMARK]
by
[COMPANY NAME]

FIG. 10c

!! CAUTION !!

Possible JAM at the
Ball Return

FIG. 10d

TRAINING

| | | | |
|---|---|---|---|
| Strikes: | 14 | 70% | 43MPH |
| Balls: | 6 | 30% | 56Max |
| Total: | 20 | | 22Min |

FIG. 10e

PITCHING

| | | |
|---|---|---|
| Player 1 | 3 balls | Player 2 |
| 2 wlks | 2 strks | 4 wlks |
| 4 outs | 48 MPH | 2 outs |

FIG. 10f

INFIELDING

| | | |
|---|---|---|
| Player 1 | | Player 2 |
| 4 runs | Time | 2 runs |
| 1 outs | 3.4 sec | 2 outs |

FIG. 10g

OUTFIELDING

| | | |
|---|---|---|
| Player 1 | | Player 2 |
| 4 runs | Time | 3 runs |
| 4 outs | 6.2 sec | 2 outs |

FIG. 10h

U2
ISD2500
U3
DS1267
U6
M386V
U10
SPEAKER
142
146
148
150
VCC
VDD
C4 .1UF
C5 .1UF
R8 1K
C10 1UF
R9 10K
C11 .047 UF
C1 .1UF
C12 .01UF
C2 10UF
C3 220UF
TO FIG.12a
TO FIG.12d

BASEBALL TRAINER

BACKGROUND OF THE INVENTION

1. Field of the Invention:

The present invention is related to athletic training and game machines and more specifically to a method and apparatus for measuring and recording speed and accuracy of pitched or thrown baseballs and softballs 2. Description of the Prior Art:

Amateur baseball and softball are popular sports, and many players desire to increase their proficiency for various aspects of the game by engaging in additional practice. However, the nature of the games, based on pitched and hit balls or thrown and caught balls, generally requires at least two participants to practice even the most rudimentary skills of the sport, such as batting, pitching, throwing, and catching the ball. Unfortunately, it is not always easy to get another willing participant at any time and for any duration to assist in practice sessions. Also, there is some desire for objective measurements of performance in practice sessions, such as velocity of pitched balls and speed and throwing accuracy of infield and outfield plays.

Myriad mechanical ball pitching and throwing machines have been developed to deliver balls to batters and catchers for practice purposes. The U.S. Pat. Nos. 4,269,162, 4,524,749, 4,995,371 and 5,121,735, issued respectively to J. Abraham et at., P. Giovagnoli, J. Kuizinas, and K. Hancock, are examples of ball pitching and throwing machines, and there are many others as well. Some of them, such as the Giovagnoli machine, can be adjusted to deliver lobtype or essentially straight pitches, as desired, to the batter.

However, very little has been developed to assist pitchers or infielders and outfielders in self-practice to improve their skills. Speed radar guns are sometimes used to measure the velocity of pitched balls, and less expensive velocity calculators based on distance/time relationships, such as the U.S. Pat. No. 5,163,014, issued to J. Calimeri, have been developed to indicate pitched ball velocity. However, they require another person besides the pitcher to operate and get useful data.

SUMMARY OF THE INVENTION

Accordingly, it is a general object of the present invention to provide a baseball or softball training device that can be used alone by one person or by more persons to practice pitching, infielding, and outfielding.

It is a more specific object of this invention to provide a training device that can measure and record or tally pitching accuracy and pitched ball velocity for one or more practicing pitchers.

Another specific object of this invention is to provide practice pitching accuracy and velocity determining apparatus that does not require any assistant or other person besides the pitcher to operate and use it.

A further object of this invention is to provide a practice machine that can initiate plays and measure and record responsiveness and throwing accuracy for practicing infielders and outfielders.

It is another object of this invention to provide a game playable by one or more persons to match their pitching, infielder, or outfielder skills against each other or against themselves individually.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, the apparatus of this invention may comprise a pitcher's rubber that causes a detectable signal when a pitcher lifts his or her foot off the rubber to indicate start time of a pitch, target apparatus that causes a detectable signal when the pitched ball arrives at the target apparatus to indicate stop time, a computer connected to the pitcher's rubber and the target apparatus for determining time elapsed between the start and stop signals and for determining pitched ball speed from the distance between the rubber and the target apparatus and the elapsed time, and visual display or voice synthesizer devices for reporting the speed to the pitcher. Separate "strike" and "ball" zones in the target apparatus can indicate to the computer whether the pitch was a "ball" or a "strike", and the computer can tally and report information and statistics about a series of pitches to the pitcher, or it can compare such information to preprogrammed or selected parameters to make game competition between the pitcher and the computer or between more than one pitcher. The apparatus also includes ball catcher and ball return apparatus.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention. In the Drawings.

Figure 11:
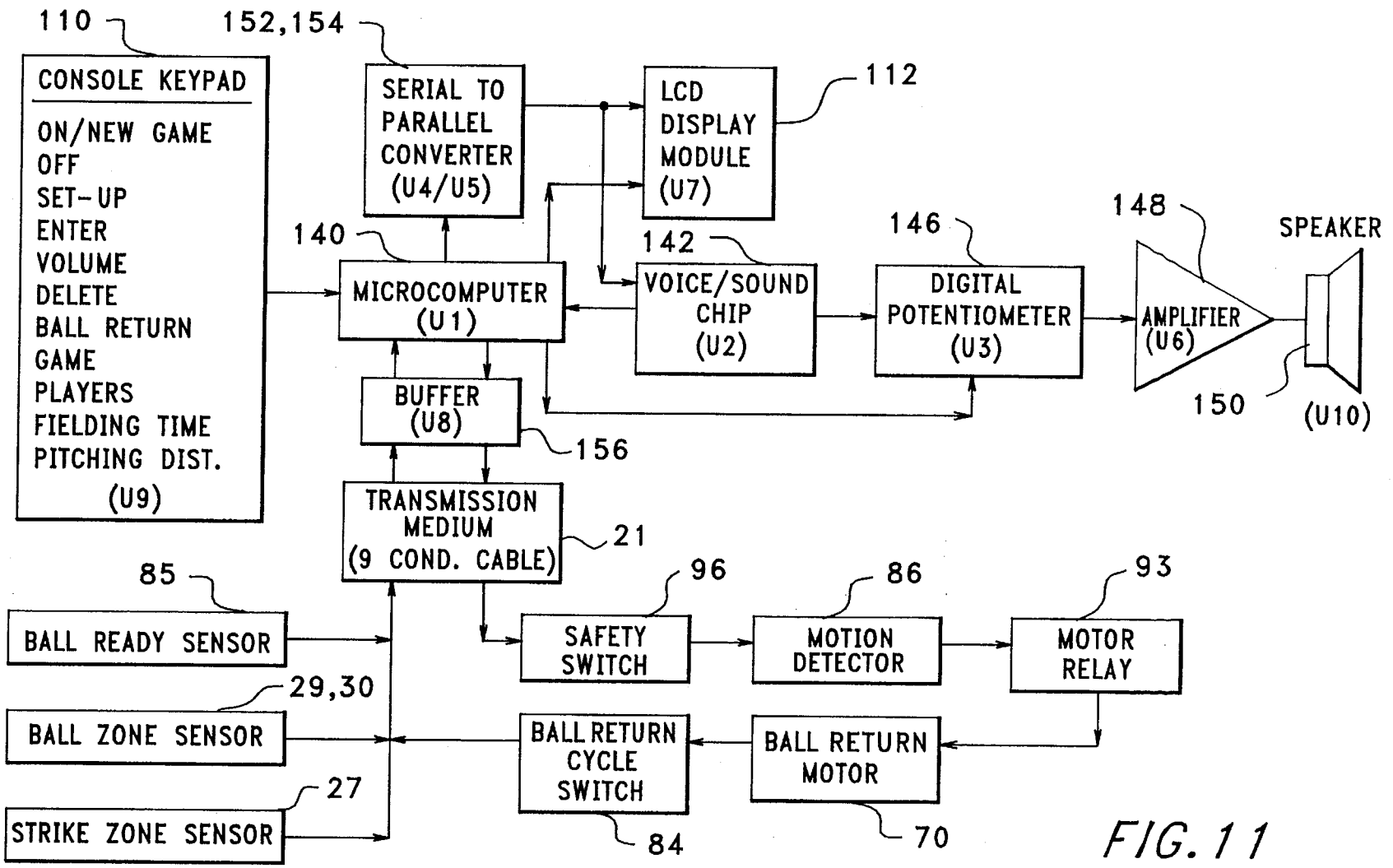
Figure 12A:
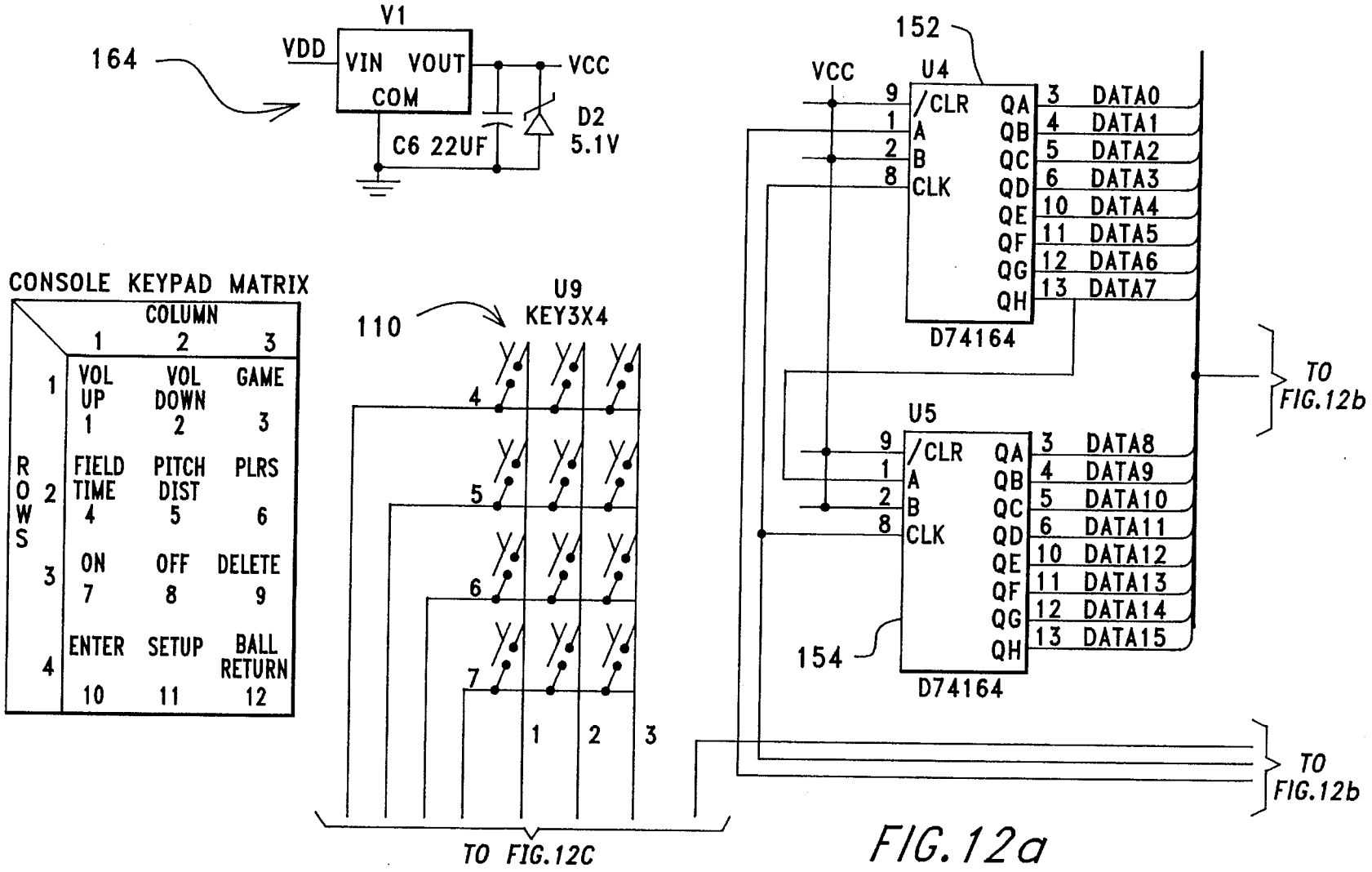
Figures 12A, 12B, 12C, 12D, 12E:
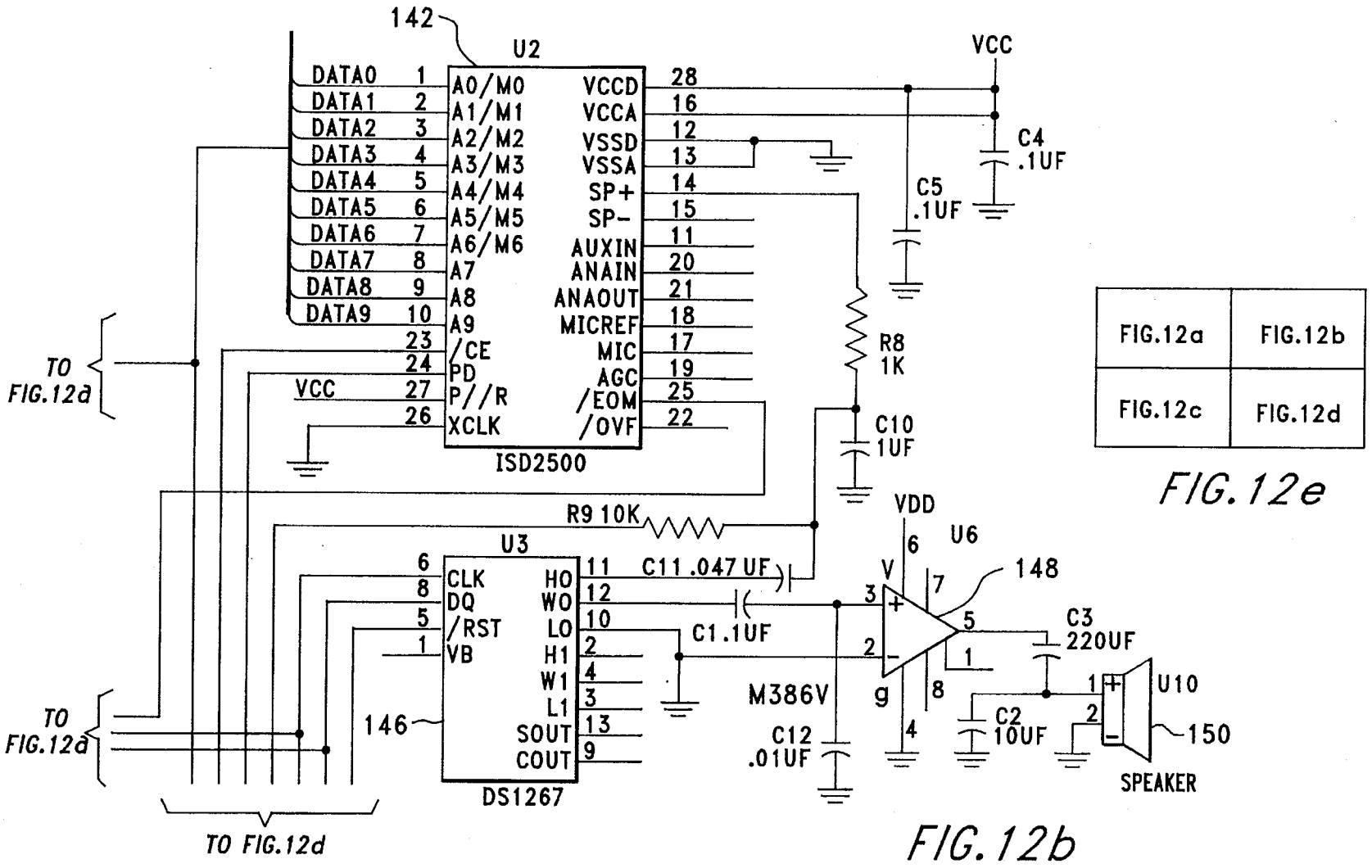
Figure 12C:
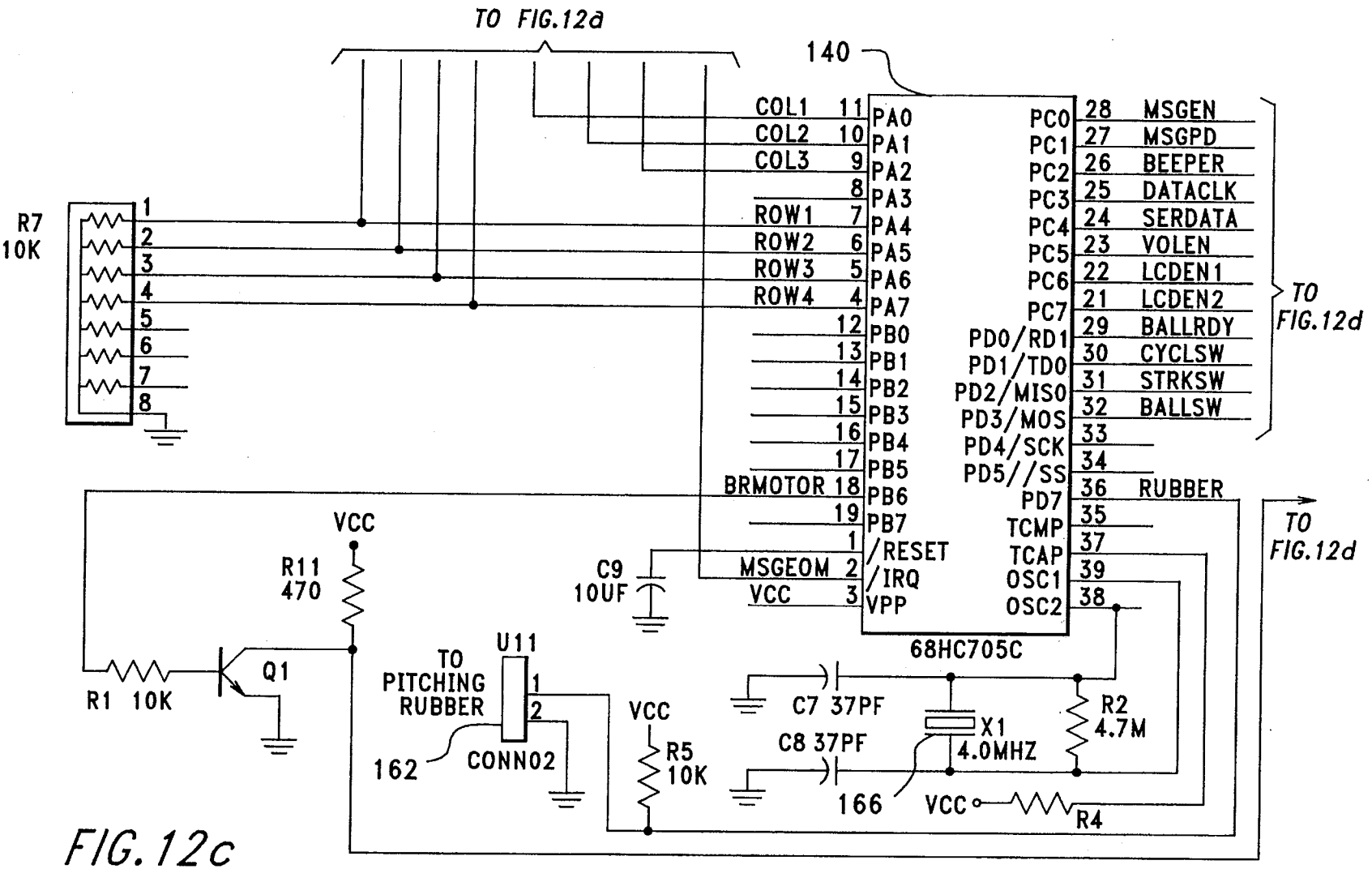
Figure 12D:
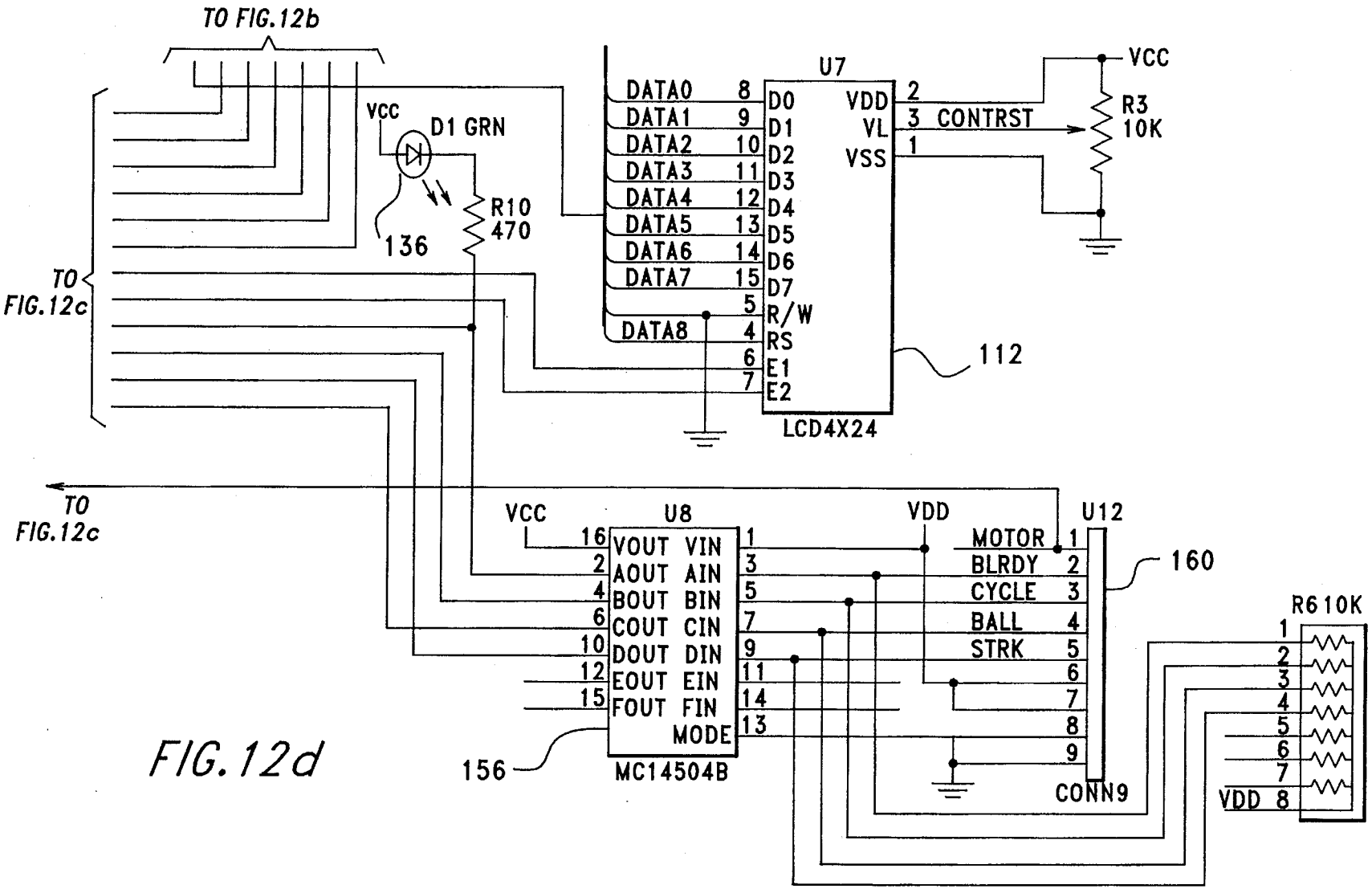
Figure 13:
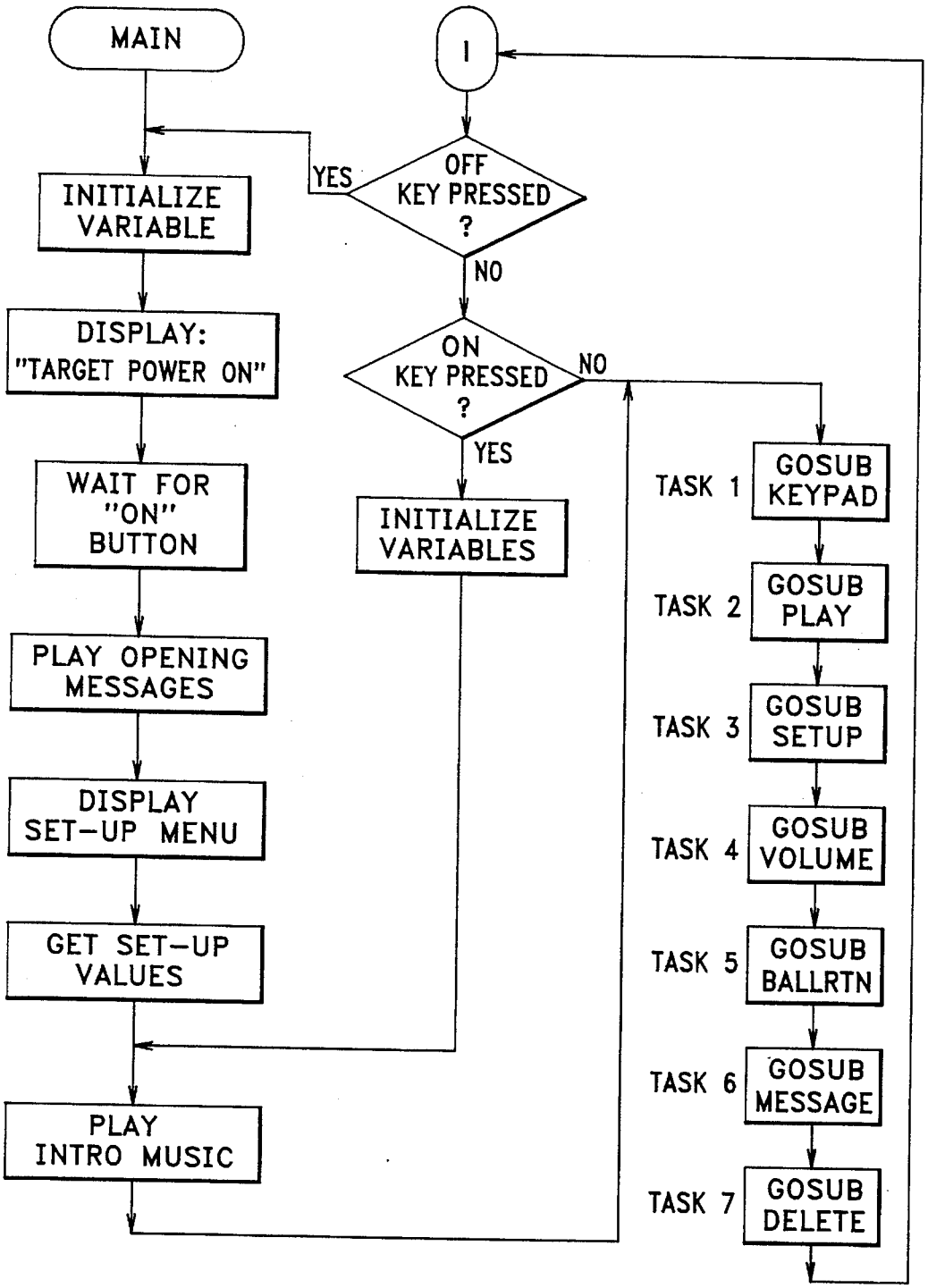

FIGS. **10*a*–10*h*** illustrate the several screen displays programmed to operate with this invention;

FIG. 11 is a functional block diagram of the electronic operating circuit of this invention;

FIG. 12 is a schematic wiring diagram of an electronic control system that provides the functions of this invention; and FIG. 13 is a flow diagram of the logic sequence of the functions programmed to operate this invention.

DETAILED DESCRIPTION OF THE PREFERRED EMBODIMENTS

Figure 1:
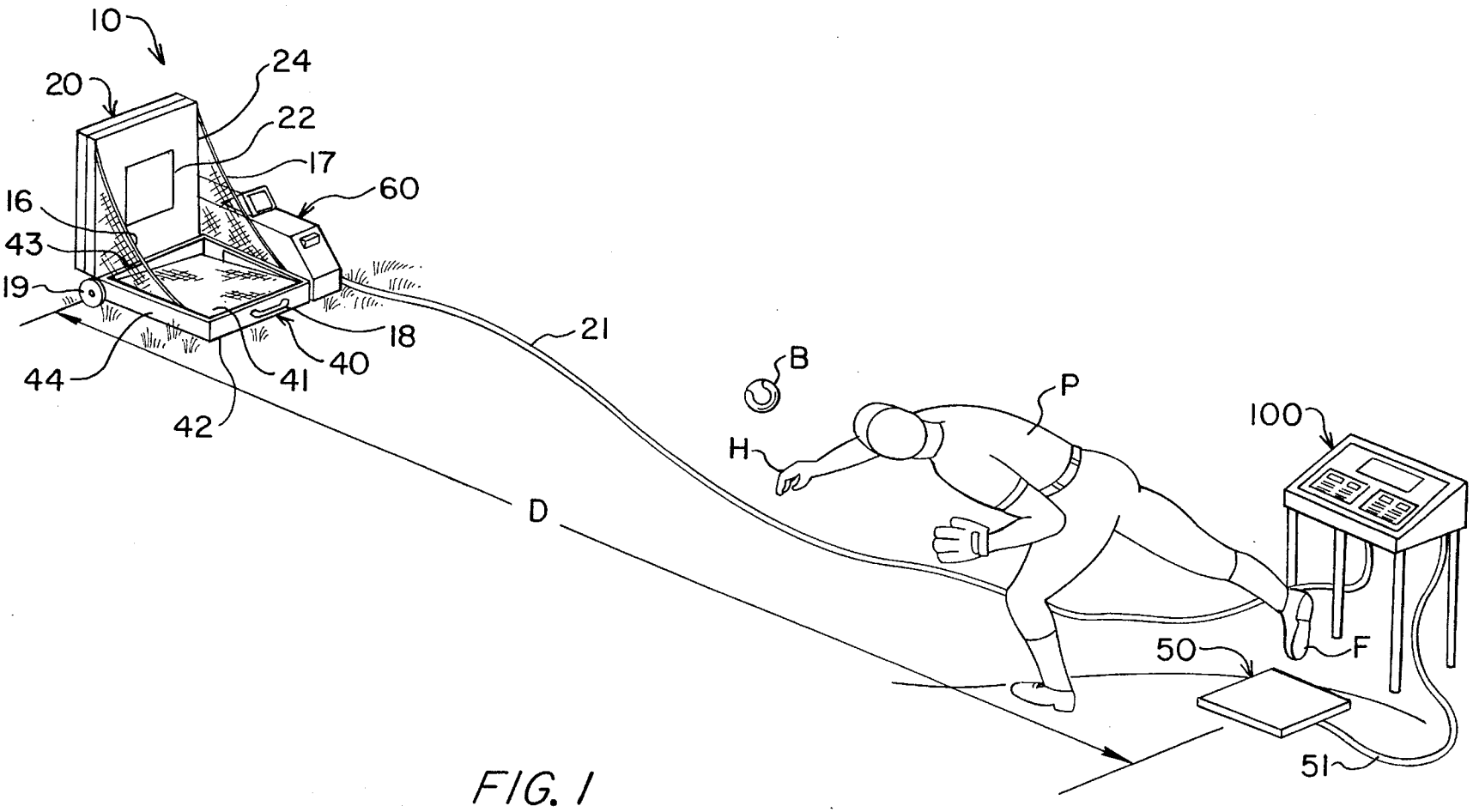
FIG. 1 is a perspective view of the pitcher trainer apparatus of the present invention as it is being used.

The pitcher trainer apparatus 10 of the present invention, as shown in FIG. 1, is designed primarily to allow a baseball or softball pitcher to practice his or her pitching skills alone, without the assistance of another person, and to provide immediate feedback regarding accuracy as well as speed of his or her pitched balls. It also provides a tally of pitched "strikes" and "balls", percentages of "strikes" pitched, velocity of the ball, and a record of maximum and minimum velocities in a set of pitches. The trainer apparatus 10 can also be operated to provide competition between two pitchers or to provide infield and outfield training, as will be described in more detail below.

Essentially, the operative principals of the pitcher trainer apparatus 10, as illustrated in FIG. 1, is that a pitching target apparatus 20 is set at a predetermined distance D from a pitcher's mound rubber 50. The distance D can be, for example, twenty-five feet for beginner children, forty-seven feet for standard little league play, or sixty feet for Babe Ruth, American Legion, and other regulation leagues. The pitcher P pitches the ball B to the target apparatus 20, which has two separately identifiable and registerable target zones—a "strike" zone 22 surrounded by a "ball" zone 24, each which detects and signals the arrival of the ball B at that zone.

The beginning of the pitch is detected and signaled by the pitcher's rubber 50, as will be described in more detail below, so that a flight time of the ball B for use along with the distance D in calculating the velocity of the pitched ball can be obtained by the time interval between the beginning of the pitch and the arrival of the ball B at the target apparatus 20. The results—"strike" or "ball" —as well as the velocity of the pitched ball B, along with other information, as will be described in more detail below, are recorded and displayed visually and/or announced verbally by a console 100. The signals indicating ball B arrival at "strike" zone 22 and "ball" zone 24 are provided to the console 100 electronically via a cable 21.

The beginning of the pitch is signaled, according to this invention, by taking advantage of the fact that most pitchers P, when pitching in conventional form and technique for either overhand or underhand throw, will raise the foot F off the pitcher's rubber 50 at almost exactly the instant the ball B is released from the pitching hand H, or at least so close to the same instant that variations are insignificant for purposes of training. Therefore, the pitcher's rubber 50 is structured with a switch mechanism that will be described in more detail below to detect and signal when the pitcher's P foot F is placed on the rubber 50 and when the foot F is removed from the rubber 50. Those signals are conveyed electronically via a cable or cord 51 to the console 100, which contains a microcontroller unit and associated electronic circuitry and software to utilize the signals and the information to the pitcher P, as will be described in more detail below.

In addition to recording and reporting information about the pitch, the trainer apparatus of this invention returns the ball B to the pitcher P or otherwise throws the ball B for fielding practice as will be described in more detail below. Therefore, referring to FIG. 2, the ball B is first pitched to the target apparatus 20, where the flight path 11 illustrates contact 12 with the "ball" zone 24. A more accurately pitched ball B would, of course, have contacted the "strike" zone 22, instead of the "ball" zone 24. In either case, the ball B drops down to a ball catcher apparatus 40, positioned in front of the target apparatus 20, as indicated by the ball and bounce path 13, where it is caught or arrested as indicated at B'. The catcher apparatus 40 has a surface 41 that slopes toward a ball return apparatus 60, so that the caught ball rolls as indicated by roll path 14 to the entrance of a magazine for the ball return apparatus 60, as indicated at B". The ball return apparatus 60, which will be described in more detail below, propels the ball, as indicated at B'", in a trajectory 15 back toward the pitcher's rubber 50, where the pitcher P (not shown in FIG. 2) can catch it and then pitch it again. A pair of net sidewalls 16, 17 can be extended on both the left and right side between the target apparatus 20 and the catcher apparatus 40, as shown in both FIGS. 1 and 2, to confine side-bouncing balls to the catcher apparatus 40.

Figure 2:
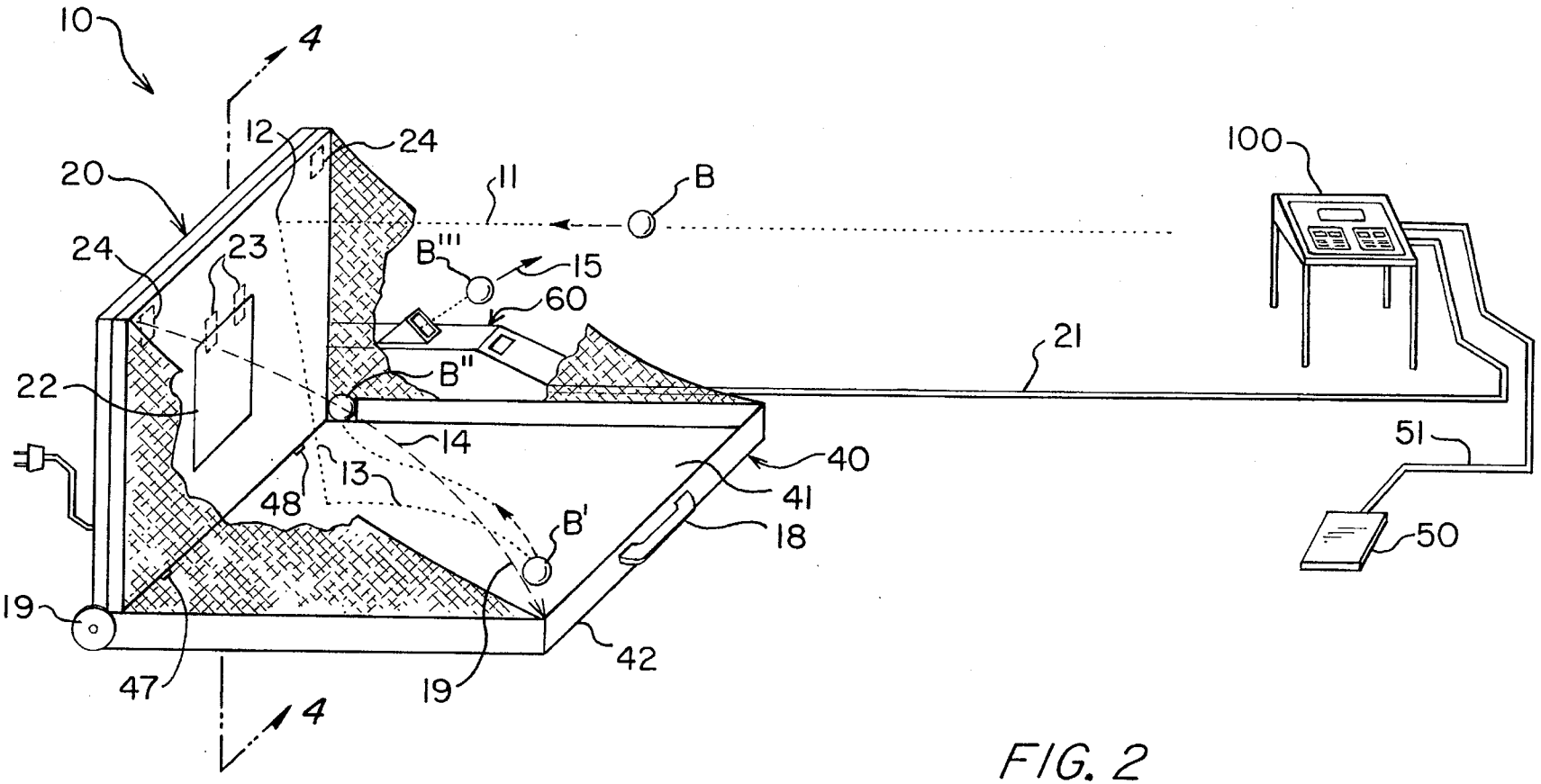
FIG. 2 is a diagrammatic view of the pitcher trainer apparatus illustrating a path of travel of a ball through sequential functions of the apparatus of this invention.

The target apparatus 20 can be hinged to the catcher apparatus 40, such as by hinges 47, 48 as shown in FIG. 2 and described in more detail below, so that the target apparatus 20 can be folded down and together with the catcher mechanism 40 as indicated by the broken arrow 19 for portable moving and storage. A handle 18 on the front panel 42 and a set of wheels 19 on the back panel 43 of the catcher apparatus 40 facilitate portability.

Figure 3:
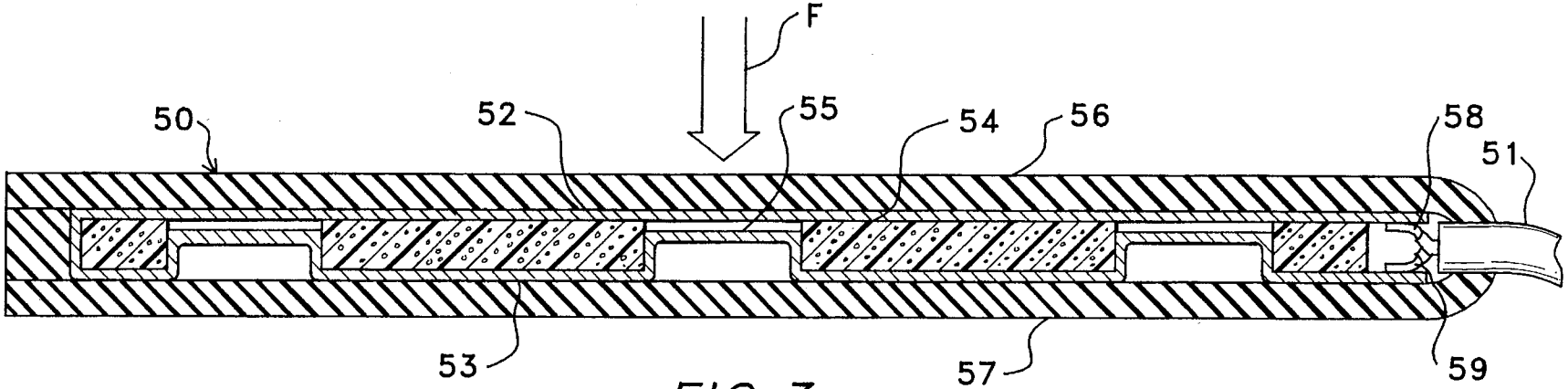
FIG. 3 is a cross-sectional view of a pitcher's rubber that can provide the switching function needed to operate this invention.

The pitcher's rubber 50 is illustrated in cross-section in FIG. 3. Its function, as described above, is essentially as a weight or pressure-sensitive switch, so that it senses and can send a signal when the pitcher P (FIG. 1) steps on the rubber 50 with his or her foot F and/or when he or she removes his or her foot from the rubber 50. There are many such touch or weight-sensitive switches available that could be used for this purpose, and the embodiment shown in FIG. 3 is but one example. Two metal contact strips or sheets 52, 53 are kept normally separated from each other by resilient cushions 54, such as foam rubber. The bottom contact 53 is shaped with a plurality of ribs 55 that rise toward the top contact 52 at locations where there is nothing between the top and bottom contacts 52, 53 except an air space. The assembly of the top and bottom contacts 52, 53 and the resilient cushions 54 is sandwiched between protective top and bottom sheets of flexible rubber 56, 57, respectively. Wire leads 58, 59 from cable 51 are connected respectively to top and bottom contacts 52, 53 for carrying electricity to and from the console 100 (FIG. 1).

When a force indicative of a pitcher's weight on his or her foot F is placed on the top sheet 56 of the pitcher's rubber 50, as indicated symbolically by the arrow F in FIG. 3, with the bottom rubber sheet 57 positioned on the ground, the top rubber sheet 56 and top contact 52 flex downwardly until the top contact 52 touches a rib 55 of the bottom contact 53, thereby making electrical contact between the top and bottom contacts 52, 53. When there is a voltage potential between the wire leads 58, 59, such electrical contact between the top and bottom contact strips 52, 53 completes a circuit, which is detectable in the console 100 (FIG. 1). As a corollary, release or removal of the force or weight of the pitcher's foot F will allow the resilient cushion 54 to push top contact 52 away from bottom contact 53 and break the electric circuit, which is also detectable at the console 100. Therefore, a signal is detectable in the console 100 the instant the pitcher's foot F leaves the rubber 50, which, as described above, is usually also indicative of when the ball B is released from the pitcher's hand H.

Of course, as mentioned above, other switch structures or configurations for use in the pitcher's rubber 50 are also available, and, it would be possible to persons skilled in the art to configure a switch to work in the opposite manner, i.e., break the electric circuit when the weight of the pitcher's foot F is applied to the rubber 50 and complete the circuit when it is removed. Either way, such signals indicative of when a pitcher places his or her foot F on the rubber 50 and then removes it are detectable at console 100, thus would be equivalents for purposes of this invention.

Figure 4:
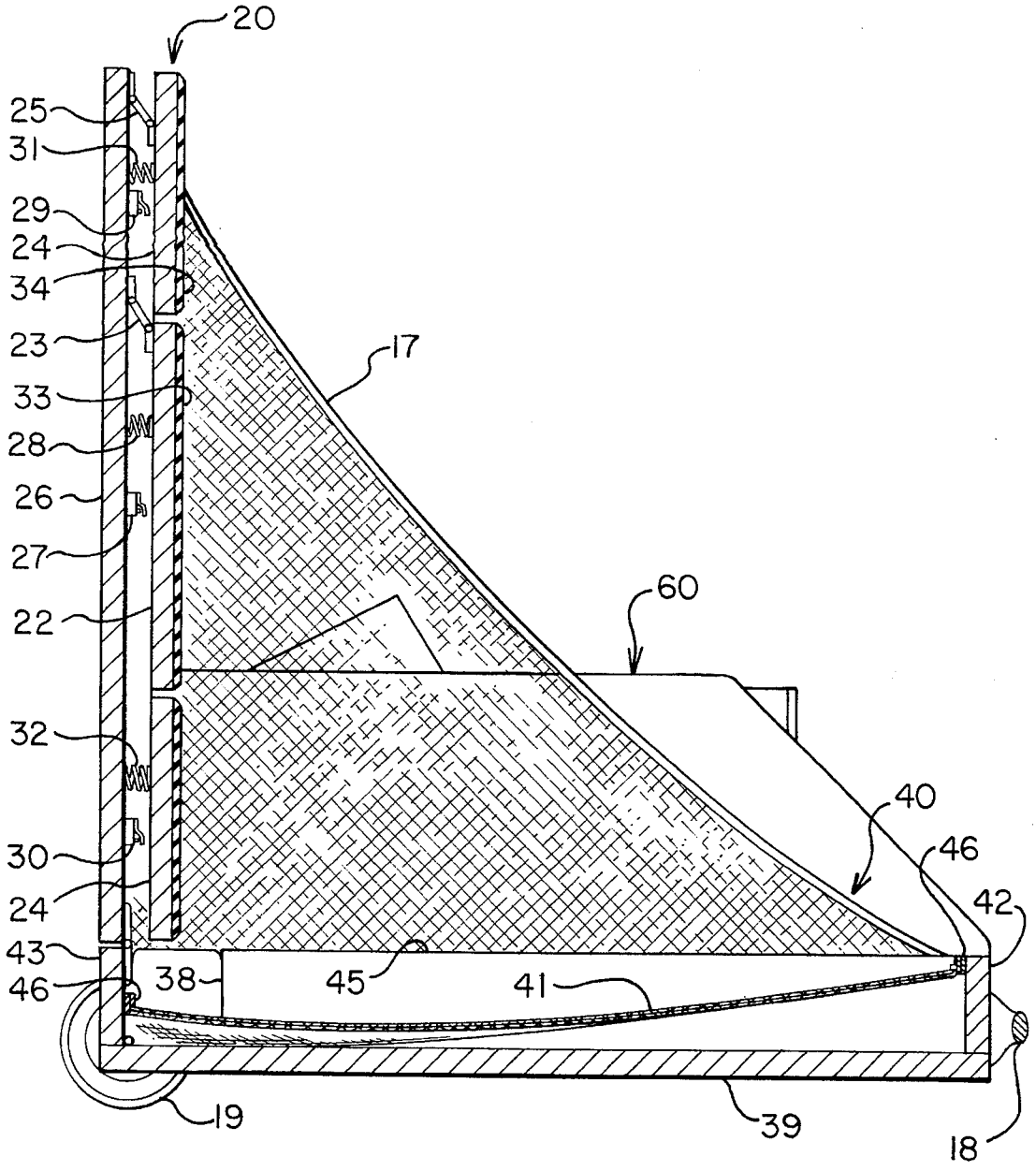
FIG. 4 is a cross-sectional view of the ball target/catcher apparatus taken substantially along lines 4—4 of FIG. 2.

Referring now to FIG. 4, the assembly of the target apparatus 20 and the catcher apparatus 40 is shown in cross-section. Again, the principal function of the target assembly 20 is to register when the ball B (not shown in FIG. 4) impacts either the "strike" zone 22 or the "ball" zone 24. Therefore, there are many structural variations by which this function can be accomplished for purposes of this invention, of which the structure shown in FIG. 4 is but one illustrative embodiment.

A "strike" zone target panel 22 is shown suspended in front of a back panel 26 by double hinges 23 in the center of the target apparatus 20 surrounded by a "ball" zone target panel 24, which is also suspended in front of the back panel 26 by similar double hinges 25. The double hinges 23, 25 allow the panels 22, 24 to hang substantially vertically while being moveable substantially horizontally when impacted by a pitched ball. While not seen in the cross-section of FIG. 4, it is preferred that there be at least one of said double hinges 23 at each upper corner of the "strike" zone panel 22 and one of the double hinges 25 at each upper corner of "ball" zone panel 24, as shown in phantom lines in FIG. 2. Additional double hinges (not shown) can be added if additional stability is needed, such as near the bottom edges of the panels 22 and 24 to hold them from swinging outwardly away from the back panel 26 when the target assembly 20 is being folded down to the catcher assembly 40 for storage or transport.

Referring now again to FIG. 4, an electric contact or microswitch 27 is positioned between the "strike" zone panel 22 and the back panel 26, so that the momentum of a ball impacting the "strike" zone panel 22 will move the "strike" zone panel 22 toward the back panel 26 and actuate the switch 27. Such actuation sends a signal to the console 100 via cable 21 (FIG. 1), which signifies that the pitched ball hit the "strike" zone panel 22 and the time that it hit. The microcontroller in the console 100, which will be described in more detail below, can then compare the time elapsed between the signal from the pitcher's rubber 50 and the signal from the "strike" zone panel 22 of target apparatus 20 to derive the flight time of the ball B, from which it can then, using the distance D to calculate the velocity of the pitched ball B. One or more small compression springs 28 can also be positioned between the "strike" zone panel 22 and the back of the "strike" zone panel 22 just off the switch 27. Such springs 28 should, of course, be weak enough to allow sufficient movement of the "strike" zone panel 22 to actuate the switch 27, even under the impact of a ball pitched by a small, inexperienced child.

The "ball" zone panel 24, as shown in FIG. 4, is also suspended by double hinges 25 to be moveable backward toward the back panel 26 from the momentum imparted by the impact of a ball B. Also, microswitches 29, 30 and springs 31, 32 are provided between the "ball" zone panel 24 and back panel 26, as described above for the "strike" zone panel 22, to provide electric signals indicative of a ball hitting the "ball" zone panel 24. However, because of its size, it is advisable to mount more switches 29, 30 at divers locations behind the "ball" zone panel 24, because of its larger size, to ensure that a ball hitting anywhere on the "ball" zone panel 24 will result in a signal.

A signal from one of the switches 29, 30 is used by the microcontroller in the console 100 to calculate velocity of the pitched ball in the same way as described above for a signal from switch 27. However, the ball impact is recorded and reported by the console 100 as a "ball" instead of a "strike". If the ball B impacts at the boundary between the "strike" zone panel 22 and the "ball" zone panel 24 so that signals from both are generated simultaneously, the microcontroller in console 100 can be programmed to ignore one of them, such as the one from the "ball" zone panel 24, so that the impact is recorded as a "strike".

The front surfaces of the "strike" zone panel 22 and the "ball" zone panel 24 can be covered with cushion material 33, 34, respectively, to prevent the ball B from bouncing away so far that it does not fall into the catcher apparatus 40. Of course, too much cushion could absorb so much of the impact from the ball that it would not move the panel 22 or 24 enough to actuate the switch 27, 29, or 30. However, it is not difficult to provide a suitable balance between deadening the bounce and moving the panel 22 or 24.

The catcher apparatus 40, as best seen in FIGS. 1 and 4, comprises a shallow, box-shaped structure with a bottom wall 39, front wall 42, back wall 43, left wall 44, and right wall 45, and it is positioned in front of the target apparatus 20. A sloped surface 41 extends across the interior of the catcher apparatus 40 and is inclined toward an outlet opening 38 in the rear part of the right side wall 45. Therefore, a ball B that drops into the catcher apparatus 40 after hitting the target apparatus 20 will roll to the outlet opening 38 and into the magazine of the ball return apparatus 60. The sloped surface 41 can be a flexible fabric sheet, as shown in FIGS. 1 and 4, to further dampen the energy of the bouncing ball B, so it does not bounce out of the catcher apparatus 40, or it can be a rigid structure (not shown) but padded to absorb energy and dampen the bounce of the ball.

To facilitate portability, as mentioned above, the back panel 26 of the target apparatus 20 can be hinged to the back wall 43 of the catcher apparatus 40, so that the target apparatus 20 can be folded together with the catcher apparatus 40. The sloped surface sheet 41 can be removably fastened to the walls of the catcher apparatus 40, such as with hook and loop (Velcro™) fasteners 46, so it can be unfastened and removed or laid on the bottom 39 to accommodate a more compact fit of the panels 22, 24 in the box-like structure when folded. The handle 18 and wheels 19 make the folded target and catcher assembly easier to move.

The ball return apparatus 60 is best described by reference to FIGS. 5, 6, and 7, in combination with FIG. 1. It comprises essentially an elongated, pivotally mounted throwing arm 61 powered by a throwing spring 62, a cocking assembly 63 for positioning the arm 61 and stretching the spring 62 for throwing the ball B, and a magazine assembly 64 for loading balls B into a cup 65 on the end of the arm 61. When the arm 61 is released with a ball B in the cup 65 after being cocked, the spring 62 pulls it upwardly very fast until it is stopped by a bumper plate 66, as shown by the phantom lines 61' in FIG. 6, to propel the ball B''' in a trajectory 14 back toward the pitcher P, as described above. Different strength springs 62 can be used for harder or softer throws, long fly balls, grounders, and the like. An adjustable deflector plate 109 mounted pivotally on the edge of the cup 65 can be used to modify the trajectory of the ball B.

The cocking assembly 63 comprises a cocking wheel 67 with a cam pin 68 extending axially from the wheel 67 near its periphery. A drive motor 70 operating through a reduction gear box 69 rotates the cocking wheel 67. As the cocking wheel 67 rotates in the direction indicated by the arrow 71 in FIG. 6, the cam pin 68 contacts the midportion of arm 61 and forces it to pivot downwardly about its mounting pin 72 against the bias of spring 62. A metal plate 73 on the arm 61 serves as a smooth, wear-resistant cam follower surface on the arm 61 for interfacing with the cam pin 68.

Figure 5:
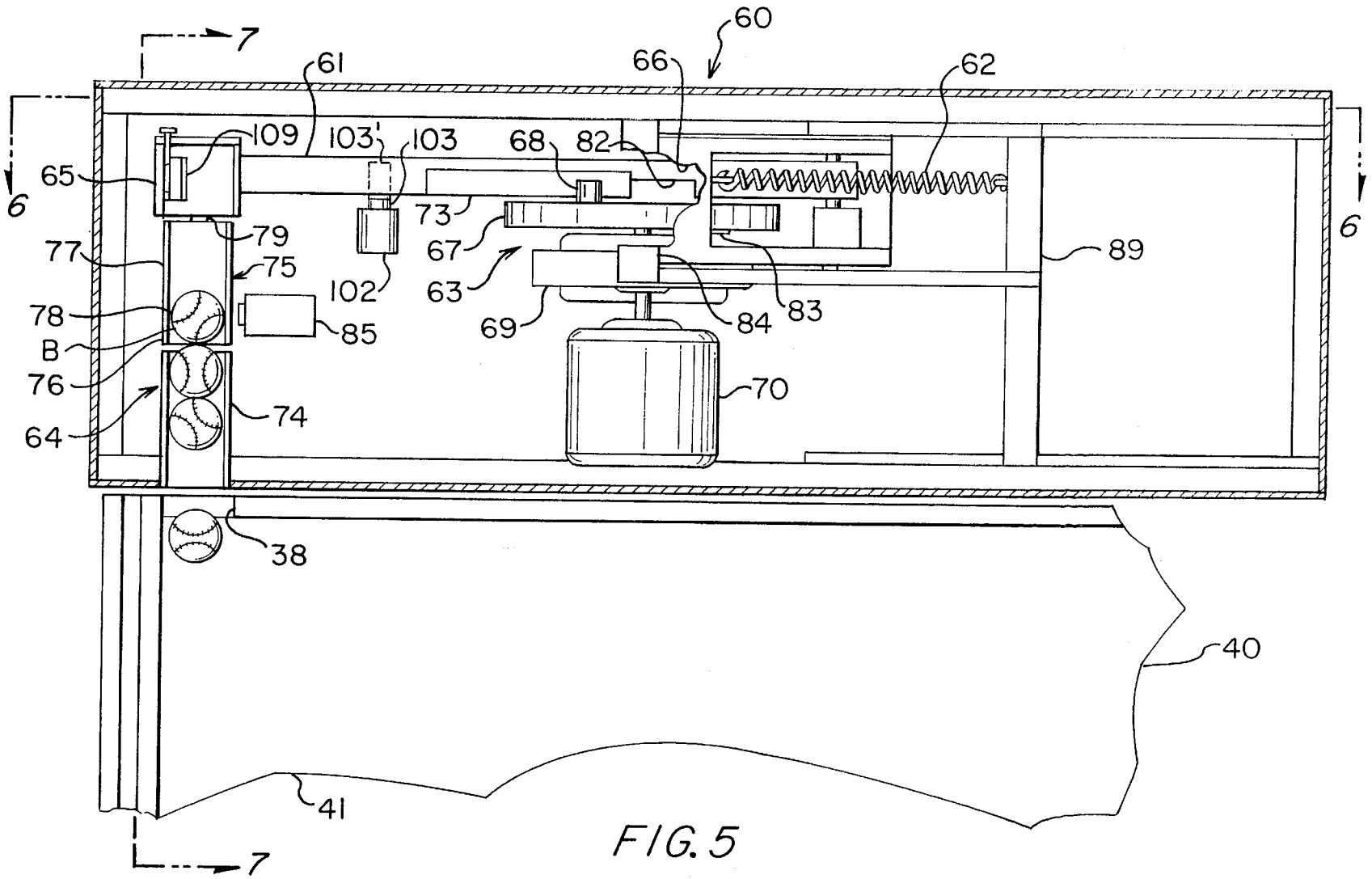
FIG. 5 is a plan view of the ball return apparatus taken substantially along lines 6—6 of FIG. 5.
Figure 7:
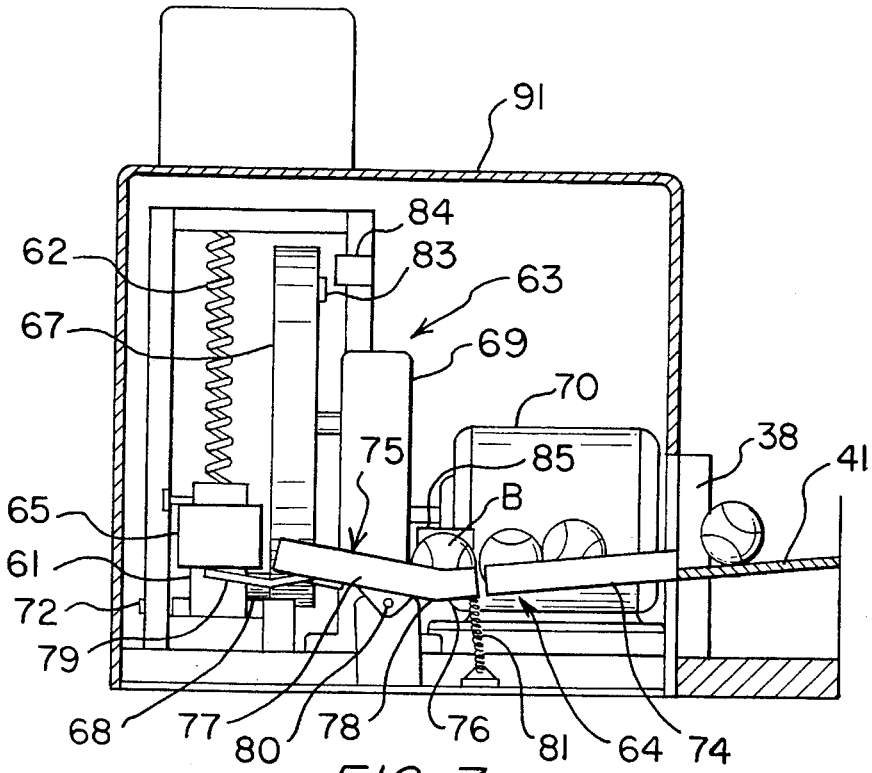
FIG. 7 is a rear elevation view of the ball return apparatus taken substantially along lines 7—7 of FIG. 5.

When the arm 61 is lowered by the cocking wheel 67 and cam pin 68 to the level of the magazine assembly 64, as best seen in FIGS. 5 and 7, the ball B loading operation is actuated. The balls B roll from the sloped surface 41 of the catcher apparatus 40, through the opening 38 and into the magazine holding trough 74, which is inclined toward the cup 65 on the distal end of arm 61. A pivotally mounted loading chute 75 is interposed between the holding trough 74 and the cup 65. The loading chute 75 has a short, slightly downward inclined portion 76 before bending into a longer, upwardly inclined portion 77 to form a pocket 78 that is just large enough to hold one ball B.

As the cup 65 on the distal end of arm 61 is lowered further, it contacts and pushes downwardly on a finger 79 that is attached to and protrudes from the end of the loading chute 75, which causes the loading chute 75 to pivot about its mounting pin 80 until the portion 77 tilts downwardly and the ball B rolls into the cup 65. At the same time, the other portion 76 tilts upwardly, which stretches a spring 81 upwardly in front of the trough 74 where it prohibits the next ball in trough 74 from advancing.

Figure 6:
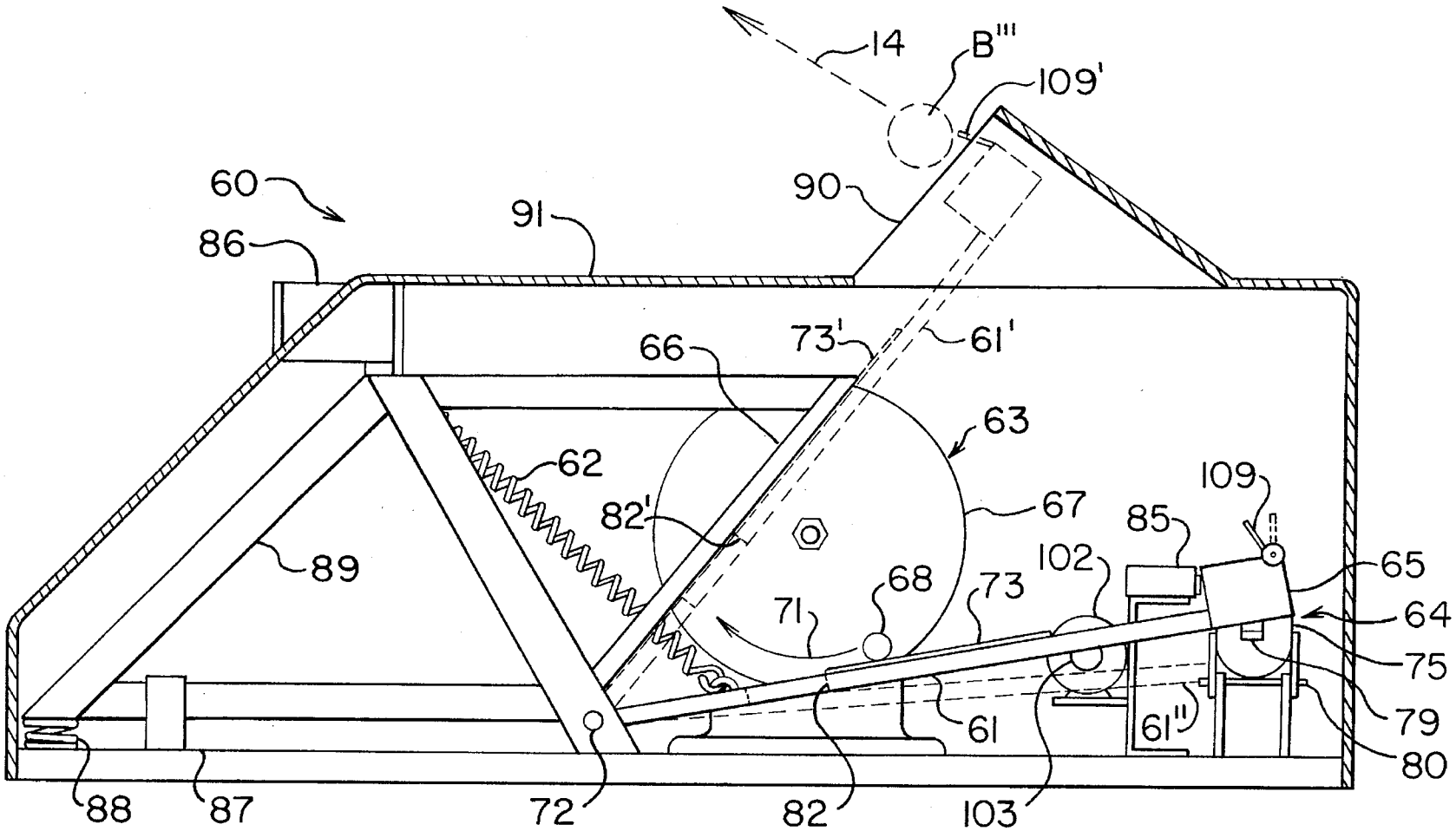
FIG. 6 is a right side elevation view of the ball return apparatus taken substantially along lines 6—6 of FIG. 5.

With the ball B loaded into the cup 65, as described above, the cocking wheel 67 continues to rotate, as best seen in FIGS. 5 and 6, until the cam pin 68 slides off the edge of the metal plate 73 and into the slotted notch 82 in arm 61. At that point, there is nothing holding the arm 61 down, so the throwing spring 62 pulls the arm 61 forcefully upwardly to the phantom line position 61' to throw the ball, as described above. With the cup 65 no longer beating on finger 79 (FIG. 7), the spring 81 can pull the loading chute 75 back to its normal position, so the next ball in the holding trough 74 can roll into the pocket 78 of loading chute 75.

Figure 8:
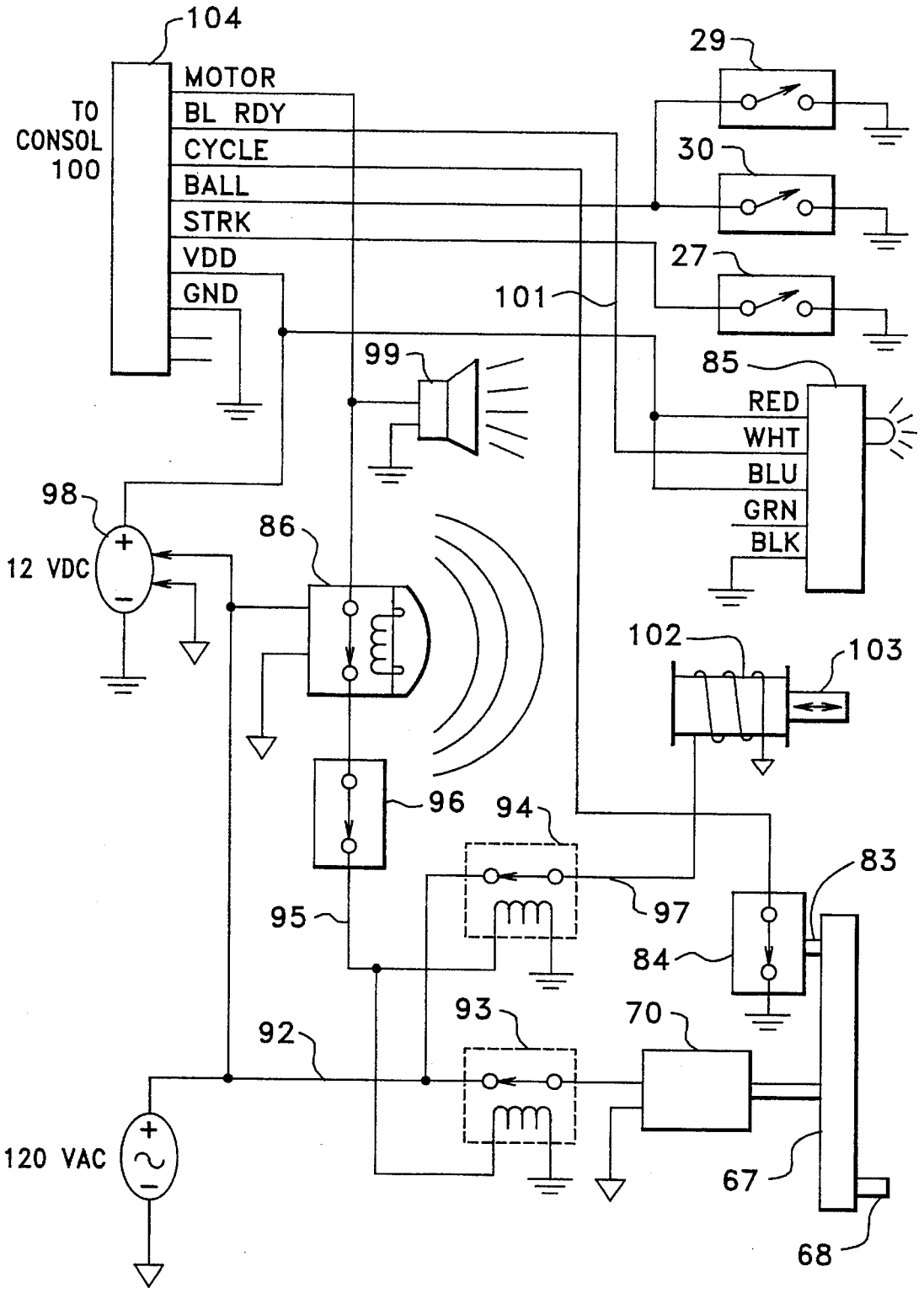
FIG. 8 is schematic wiring diagram of the ball return apparatus.

When the arm 61 is cocked all the way down to its full-cocked position 61", as shown in FIG. 6, and the cam pin 68 is just set to go over the edge of metal liner 73 and into slotted notch 82, it is unstable in the event of power shut-off, and any slight movement could cause it to allow the arm 61 to fire, which could be unsafe if someone is accessing the mechanism. Therefore, a solenoid 102 is provided with a shuttle bolt 103 that is normally jutted out when there is no power and retracted within itself when there is power. This solenoid 102 is positioned adjacent the arm 61 when it is fully cocked such that the shuttle bolt 103 when extended, as best seen in FIG. 5, blocks the release of the arm 61. The solenoid 102 is wired in parallel with the motor 70, as shown in FIG. 8, so that anytime power is cut off to the motor 70, it is also cut off to solenoid 102 to allow the shuttle bolt 103 to be jutted out in its arm-blocking position.

As soon as the cam pin 68 slides over the edge of the metal liner 73 into slotted notch 82 and the arm 61 fires or propels the ball B into its trajectory 14, as described above, the power is turned off to the motor 70 in response to a magnet 83 on the opposite side of the wheel from the cam pin 68 (see FIG. 7) rotating at the same instant into alignment with a magnetic switch 84. The magnetic switch 84 is actuated by the magnet 83 to send out a signal to stop the motor 70. The cocking assembly 63, loading magazine 64, and arm 61 remain inactuated in that position until a load signal from the console 100 actuates the motor 70 to start again to cock the arm 61 and load the cup 65 for another throw. When the ball return apparatus 60 is being used to simulate a batter hitting the ball from home plate in the infield or outfield practice mode as described in more detail below, the signal from the magnetic switch 84 is also used to signal the start of a time period set in the microcomputer in which the practicing fielder has to field the ball and throw it accurately back to the target apparatus 20 positioned at home plate, as will also be described in more detail below.

A ball detector 85 positioned adjacent the pocket 78 of chute 75 can be provided to detect the presence of a ball B in the pocket 78. If no ball is present in the pocket 78, a signal from the ball detector 85 can prevent the motor 70 from operating to cock the arm 61. The ball detector 85 can be, for example, an infrared emitter and detector, an electric eye, or any of a variety of other commercially available detector devices that can detect the presence of an object.

A motion sensor 86 can also be mounted in the front of the ball return apparatus 60 to send out a signal that prevents operation of the motor 70 when a person is sensed in the vicinity of the ball return apparatus 60.

Compression spring 88 in the frame 89, as shown in FIG. 6, can cushion shock and rigid jarring when the arm 61 hits the bumper plate 66 during firing, while a U-shaped anchor 87 limits upward rotation of the frame 89 as the cock assembly 63 stretches the spring 62. An opening 90 in the housing 91 accommodates ejection of the ball B out of the ball return apparatus 60.

A schematic wiring diagram for the ball return apparatus is illustrated in FIG. 8, wherein the motor 70 is shown powered by conventional 120 volt AC power via power lead 92. A solid state relay 93 in the power lead 92 is operated by a control circuit 95 from the microcontroller in the console 100 to actuate and deactuate the motor 70. A normally closed housing switch 96, not shown in FIGS. 5–7, but indicated in FIG. 8, can be included in the control circuit 95 to open and disable the circuit 95 when the housing 91 (FIGS. 6 and 7) is removed from the rest of the ball return apparatus 60. The motion sensor 86 operates a normally closed switch in the motor control circuit 95 to open the control circuit 95 and deactuate the motor 70 when a person is detected within the sensitivity distance of the motion sensor 86, such as ten feet, to prevent the ball return apparatus 60 from firing or throwing the ball. A beeper 99 is also powered by the control circuit 95 to sound a warning whenever the motor 70 is actuated.

A 12 volt DC power supply 98 powered by the 120 volt AC power source provides 12 volt DC power to the console 100 via the 9-pin connector 104 and cable 21 (FIG. 1) to power all the circuitry and controls. The safety solenoid 102 is powered by 120 volts AC power switched on by the motor control circuit 95 and relay 94 to retract its lock bolt 103 from the throwing arm 61 (FIGS. 5 and 6) whenever there is power to the motor 70. The ball detector 85 completes a circuit 101 from the motor control circuit 95 back to the console 100 when a ball B is detected in the magazine pocket 78 to let the microcontroller in console 100 know that a ball B is ready for loading. The magnetic switch 84 signals the microcontroller in console 100 via a circuit 97 when actuated by the magnet 83 on cock wheel 67 to deactuate the motor 70 when the cock wheel has completed one cycle. The microcontroller then resets the controls to begin another cock cycle upon an appropriate input from the user, as will be described in more detail below. The microcontroller is also programmed to monitor the time a cycle of the cock wheel 67 from the time the motor 70 is actuated to when it is deactuated by the magnetic switch 84, and if more than a preset amount of time passes, probably due to a jammed or broken mechanism in the ball return apparatus 60, it shuts off the power to the motor 70. For example, if a normal cock cycle takes eight seconds, the microcontroller can be programmed to shut off power to the motor 70 if no signal is received from the magnetic switch 84 within ten seconds.

The "strike" zone switch 27 and ball" zone switches 29, 30 are also connected to the console 100 via the connector 104. The signals from the switches 27, 29, 30 are used to register "strikes" and "balls" and for calculating velocity, as described above.

As mentioned above, the scoreboard console 100 uses a microcontroller to monitor the "ball" and "strike" zone switches 27, 29, 30, to control the ball return sequencing, and to calculate and display the pitching and fielding statistics. The console 100 in one embodiment of this invention allows for one or two players or users. Other controls on the console include speaker volume, new game, delete last throw, pitching distance, and maximum fielding time.

There are four training sequences or games that can be played with the console 100 according to an embodiment of this invention. The first game is essentially for pitcher training. In this game, the pitcher P delivers pitches to the target apparatus 20, and a running total of "strikes" and "balls" along with percentage of strikes thrown, miles per hour, maximum miles per hour, and minimum miles per hour is displayed. This game is for one player.

The second game is a pitching game, and one or two can play. Each pitcher P throws pitches to the target apparatus 20 and will either "strike out" or "walk" a simulated batter. The number of "strike outs" and "walks" are displayed for each player. The game ends when six "strike outs" are achieved. Velocity is also displayed for each pitch.

The third game is infielding, which enables one or two players to practice fielding skills. The trainer system 10 simulates a man on third base and a batter hitting a ground ball to an infielder, which is simulated by the ball return apparatus 60. The target apparatus 20 simulates home plate. The infield player has a predetermined number of seconds, comparable to a man running from third base to home plate, in which to catch the ball, throw it home, and hit the "strike" zone panel 22 to score an "out". Failure to hit the "strike" zone panel 22 within the predetermined time results in a scored "run" for the simulated runner. The number of "outs" and "runs" are displayed for each infield player. Actual fielding time in seconds and tenths of seconds is also displayed for each fielding play. The game ends when nine "outs" are achieved.

The fourth game, also for one or two players, is set up much like the third game, but the ball return apparatus 20 is set to project fly balls to the outfield. In this outfield training game, however, hitting either the "strike" zone panel 22 or the "ball" zone panel 24 within the preset time will score an "out" because of the greater distance that has to be thrown.

The "strike" zone panel 22 is, for example, 17×22 inch size, while the surrounding "ball" zone panel 24 has outside dimensions of 4×4 feet. The spring 62 can be changed to provide longer, shorter, or ground ball returns or throws.

Therefore, the trainer apparatus 10 can provide practice for pitchers, infielders, and outfielders, either alone or with multiple players. It is a completely objective and unbiased audible umpire and provides immediate feedback on skills improvement. Only one ball, either baseball or softball, is needed to operate the game, although more balls can be accommodated; and the apparatus is collapsible and portable.

Figure 9:
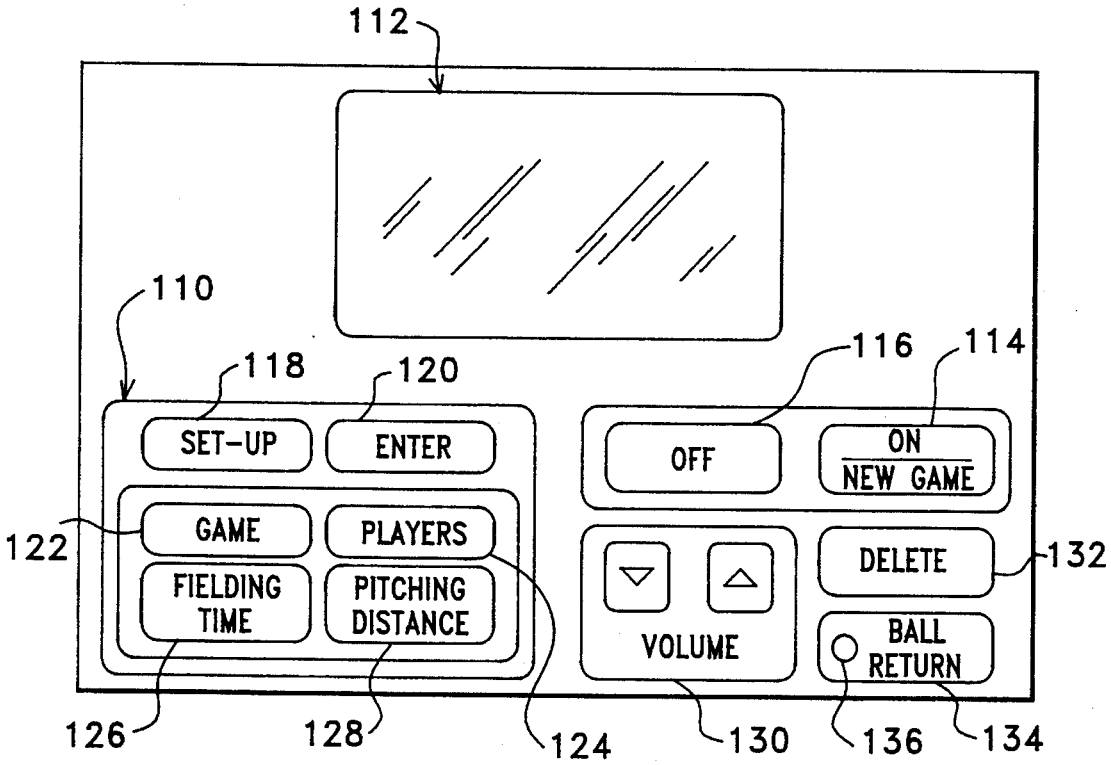
FIG. 9 is a plan view of the console layout and control features of this invention.

Referring now to FIG. 9, the console 100 has a keypad 110 for operator input and a liquid crystal display 112 for visual messages. It also has a voice simulator, amplifier, and speaker for delivering audible messages. An "ON/NEW GAME" key 114 starts the system and starts a new game, and the "OFF" key 116 stops the system. The "SET-UP" key 118 enables and displays the set-up menu on the display 112. The "ENTER" key 120 stores changes made during set-up and exits the set-up menu. The "GAME" key 122 toggles between training, pitching, infielding, and outfielding game selection options in the set-up menu. The "PLAYERS" key 124 toggles between one and two players in the set-up menu. The "FIELDING TIME" key 126 toggles between 3, 4, 5, 6, 7, and 8 seconds in the set-up menu. The "PITCHING DISTANCE" key 128 toggles between standard 25 feet, 47 feet, or 60 feet in the set-up menu, although other distance selections can also be provided. The "VOLUME" key 130 changes the volume level of the voice simulator audible messages. The "DELETE" key 132 deletes the last play of the current game. The "BALL RETURN" key 134 initiates a ball return operation sequence to actuate the ball return apparatus 60, and the ball ready indicator 136 lights to indicate that a ball B is positioned in the pocket 78 of the ball return magazine 64 as signaled by the optical sensor 85, as described above.

The LCD screen 112 can be, for example, a Hantronix™ 24 character by 4 line super twist display. FIGS. **10*a*–10*h* illustrate eight separate screen displays that are used in different phases of the games described above to display all pertinent information and statistics. For example, FIG. 10*a* shows the set-up menu; FIG. 10*b* shows the power on screen; FIG. 10*c* shows the introduction screen; FIG. 10*d* shows the jam message screen; FIG. 10*e* shows the training game information display; FIG. 10*f* shows the pitching game information display; FIG. 10*g* shows the infielding game information display; and FIG. 10*h*** shows the outfielding game information display. The information for these screen displays is stored in the microcontroller EPROM memory. Of course, other information and screens can also be stored and displayed.

A functional block diagram for the electronic control circuit of FIG. 12 is shown in FIG. 11, where the designations "Ux" indicate the same components that perform the functions described. The inputs discussed above from keypad 110 are directed to the microcomputer 140. The microcomputer chip 140, such as a Motorola™ MC68HC705C8 is the heart of the system and executes the software that is programmed into the EPROM memory. It performs a multitude of tasks simultaneously to allow a user to play the games described above without interruption. There are essentially seven main tasks performed by the software, including: (1) Monitor the keypad for user input; (2) Control and monitor the play sequence of any of the four games; (3) Make changes to the game parameters via a set-up menu when requested by the user; (4) Adjust the volume of the amplifier when requested by the user; (5) Control and monitor the ball return sequences; (6) Play a message on the voice/message chip; and (7) Delete the last play sequence when requested by the user. The main program, flow diagrammed in FIG. 13, utilizes a number of subroutines to perform these seven tasks.

The voice/message chip 142, for example, a ISD2590, stores and plays thirty-eight messages, as follows:

| | |
|---|---|
| INTRO MUSIC | ZERO |
| PLAY BALL | ONE |
| STRIKE | TWO |

-continued

| | |
|---|---|
| BALL | THREE |
| 3 & 2 FULL COUNT | FOUR |
| YOU'RE OUT | FIVE |
| TAKE YOUR BASE | SIX |
| SCALE DOWN MUSIC | SEVEN |
| CHARGE MUSIC | EIGHT |
| BATTER UP | NINE |
| WILD PITCH | TWENTY |
| YOU'RE SAFE | THIRTY |
| PAUSE | FORTY |
| ADVERTISEMENT | FIFTY |
| FINALE MUSIC | SIXTY |
| JAM AT BALL RETURN | SEVENTY |
| BALL COMING | EIGHTY |
| SETUP MENU | NINETY |
| BAT CRACK | POINT |

The address of each message is stored in the memory of the microcomputer chip 140. The "Message" subroutine in Task 6 of the flowchart in FIG. 13 handles this process by getting the message to be played off a message stack, and addressing the ISD2590 voice/message chip 142 through the serial to parallel converters 152, 154. The subroutine then enables the voice chip 142 to begin playing the message. Another message will not be played until the ISD2590 chip 140 sends a signal back to the microcomputer indicating the message is complete.

The digital potentiometer 146 (10 k ohm) allows the microcomputer chip to digitally control the volume level of the audio amplifier 148, which amplifies the audio signal from the voice chip 142 for playing by the speaker 150.

Two 8 bit serial in/parallel out shift registers 152, 154 serve as a serial to parallel converter for the microcomputer 140. The LCD display module 112 displays the information and statistics screens described above. The buffer 156 is a hex level shifter (TTL to CMOS) that acts as a buffer and shifts the 12 volt cable signals from the target apparatus 20 and ball return apparatus 60 to 5 volt signals for the microcomputer 140. Those signals are transmitted via the cable 21 to and from the sensors and switches described above and shown in FIG. 11. The 9-pin connector 160 interfaces with the 9-conductor cable 21. The two-conductor jack 162 interfaces with the two-conductor cable or chord 51 from the pitcher's rubber 50.

There is also a 12 volt to 5 volt regulator 164 for converting 12 volt power from the voltage converter 98 in the ball return apparatus (FIG. 8) to 5 volt power for the components of the electronic circuit shown in FIG. 12. The ball ready light 136 is an LED driven by the microcomputer 140 in response to a signal from the optical sensor 85 in the ball return apparatus 60, as described above.

The crystal oscillator 166 connected to the microcomputer 140 provides the system clock, as specified by the manufacturer of the microcomputer chip 140. There are a number of timing functions and calculations, as described above, for the microcomputer 140 to perform. For example, to calculate ball velocity, the timer starts when the microcomputer 140 receives a signal via connector 162 and cord 51 indicating that the pitcher's P foot F has lifted off the rubber 50. Once the ball B hits either the "strike" zone panel 22 or the "ball" zone panel 24, the corresponding signal from switch 27, 29, or 30 reaches the microcomputer 140 via the cable 21 and buffer 156. In response, the microcomputer 140 stops the timer and uses the elapsed time in a time/distance calculation to derive velocity, preferably in miles per hour, based on the distance D selected by the user as described above. Because a pitcher is often leaning forward at the actual instant of releasing the ball, a correction can be programmed into the software if desired, to correct for the differential in distance for a more accurate velocity or speed of the ball. In the event a pitched ball misses the target apparatus 20 completely, the microcomputer 140 will only time for 2.5 seconds and then actuate the voice/message chip 142 to call a "wild pitch", and the displayed miles per hour will be "0". If the pitcher steps off the rubber 50 to throw, but stops for some reason, the microcomputer timer can be reset by simply stepping back on the rubber. Also, some pitchers P step first on the rubber, lift that foot F and then put it down again just in front of the rubber during their wind-up before lifting it again during the actual act of pitching. In those circumstance, the rubber 50 of this invention or a functional equivalent can be placed just in front of a conventional pitcher's rubber, so that this rubber 50 gets the weight of the foot F during the wind-up just before the actual pitch.

Several variations of the apparatus can also be made, which would be substantial equivalents for purposes of this invention. For example, the target apparatus 20, instead of relying on panels 22, 24 to stop the ball B and cause the stop signals by movement of the respective panels from the momentum of the impacting ball B, could instead use optical detectors, motion detectors, or any of a myriad of other methods or devices to register the arrival and the "ball" or "strike" zone of the pitched ball at the target location. Also, while the description above utilizes electric cables or cords 21, 50 to conduct signals between the console 100 and the ball return apparatus 60 and pitcher's rubber 50, respectively, other signal communications media, for example, sound, ultrasound, light, infrared radiation, or radio frequency radiation, or the like, could also be used for transmission of the required signals.

The microcomputer in the console can cause the voice simulator to audibly call out any past, present or future scenario information and statistics such as, the speed of the pitched ball and the fielding time.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

The embodiments of the invention in which an exclusive property or privilege is claimed are defined as follows:

1. Trainer and game apparatus for use by a person pitching a ball, comprising:

start means for generating a start signal in response to a ball being pitched;

target means for generating a stop signal in response to arrival of the ball at a target location;

computer means connected to said start means and to said target means and receptive of said start signal and said stop signal, and operative for measuring time elapsed between the generation of the start signal and the generation of the stop signal; and reporting means connected to said computer means for reporting to the person information relating to the elapsed time;

wherein said start means includes a foot-actuated switch means positioned a distance from said target means for generating the start signal in response to the person shifting his or her weight off one foot during the act of pitching the ball toward the target means, and wherein said computer means is further operative for calculating the approximate speed of the pitched ball by dividing said distance by said time.

2. The trainer and game apparatus of claim 1, wherein said foot-actuated switch means includes a pad having a top member juxtaposed over a bottom member and being moveable against a bias toward said bottom member in response to external force applied by the person's foot, said bias being operative to move said top member away from said bottom member when said external force is removed, and start signal generating means for generating said start signal when said top member moves away from said bottom member.

3. The trainer and game apparatus of claim 2, wherein said top member includes a first electric contact and said bottom member includes a second electric contact with an electric potential between said first and second electric contacts, and wherein said first electric contact is moveable under said external force into electrical contact with said second electric contact to create it closed circuit and then moveable away from said second electric contact under said bias when said external force is removed to create an open circuit, said start signal being caused by the transition from said closed circuit to said open circuit.

4. The trainer and game apparatus of claim 3, wherein said computer means is connected to said first and second electric contacts to detect said closed circuit and said open circuit.

5. The trainer and game apparatus of claim 4, including bias means positioned between said top member and said bottom member for providing said bias of said top member away from said bottom member.

6. The trainer and game apparatus of claim 5, wherein said bias means includes compressible, electrically insulating material positioned between portions of said top member and said bottom member.

7. The trainer and game apparatus of claim 1, wherein said target means includes a "strike" zone panel surrounded by a "ball" zone panel, and also including "strike" signal means for causing said stop signal when the pitched ball impacts said "strike" zone panel and "ball" signal means for causing said stop signal when the pitched ball impacts said "ball" zone panel.

8. The trainer and game apparatus of claim 7, wherein said computer means is connected to both said "strike" signal means and said "ball" signal means to detect when said stop signal is caused by said "strike" signal means and to detect when said stop signal is caused by said "ball" signal means.

9. The trainer and game apparatus of claim 8, wherein said computer means causes said reporting means to also report to the person whether the stop signal is caused by the "strike" signal means or by the "ball" signal means.

10. The trainer and game apparatus of claim 9, wherein said reporting means includes visual display means for reporting in visual format the ball speed and whether the stop signal is caused by the "strike" signal means or by the "ball" signal means.

11. The trainer and game apparatus of claim 9, wherein said reporting means includes voice synthesizer means for reporting in audio format whether the stop signal is caused by the "strike" signal means or by the "ball" signal means.

12. The trainer and game apparatus of claim 9, wherein the computer means tallies and stores the stop signals caused by said "strike" signal means as total "strikes" and tallies and stores the stop signals caused by said "ball" signal means as total "balls"; and wherein said computer means causes said reporting means to report the total "strikes" and to report the total "balls".

13. The trainer and game apparatus of claim 12, wherein said computer means records and stores a successive block of three total "strikes" as an "out" and records and stores a successive block of four total "balls" as a "walk"; and wherein said computer means causes said reporting means to report the "out" and the "walk".

14. The trainer and game apparatus of claim 13, wherein said computer means tallies and stores the "outs" as total "outs" and tallies and records the "walks" as total "walks"; and wherein said computer means causes said reporting means to report the total "outs" and to report said total "walks".

15. The trainer and game apparatus of claim 14, wherein said reporting means reports audibly to the person.

16. The trainer and game apparatus of claim 13, wherein said reporting means reports audibly to the person.

17. The trainer and game apparatus of claim 12, wherein said reporting means reports audibly to the person.

18. The trainer and game apparatus of claim 8, wherein said computer means records and stores the calculated speed after one stop signal is detected as a first speed; and wherein said computer means records and stores the speed after a second stop signal is detected as a second speed, compares the first speed and the second speed to determine which of them is higher and which of them is lower, and records and stores the higher speed as a maximum speed; and wherein said computer means compares the speed after each subsequent stop signal is detected and compares that speed with the maximum speed to determine which of them is higher and when that speed is higher than the maximum speed then storing that speed as the maximum speed; and wherein said computer means causes said reporting means to report the maximum speed.

19. The trainer and game apparatus of claim 18, wherein said computer means records the lower of the first and second speeds as the minimum speed, and wherein said computer means also compares the speed after each subsequent stop signal is received to said minimum speed to determine which of them is lower and when that speed is lower than the minimum speed then storing that speed as the minimum speed; and wherein said computer means causes said reporting means to report the minimum speed.

20. The trainer and game apparatus of claim 19, wherein said reporting means reports audibly to the person.

21. The trainer and game apparatus of claim 18, wherein said reporting means reports audibly to the person.

22. The trainer and game apparatus of claim 7, wherein said target means includes a back panel in juxtaposed relation to said "strike" zone panel and to said "ball" zone panel; and wherein said "strike" zone panel and said "ball" zone panel are suspended in a manner that accommodates lateral movement independent of each other toward and away from said back panel; and wherein said "strike" signal means includes a "strike" switch positioned between said "strike" zone panel and said back panel, said "strike" switch being actuated to cause said stop signal when said "strike" zone panel moves toward said back panel; and wherein said "ball" signal means includes a "ball" switch positioned between said "ball" zone panel and said back panel, said "ball" switch being actuated to cause said stop signal when said "ball" zone panel moves toward said back panel.

23. The trainer and game apparatus of claim 22, including "strike" zone panel bias means for biasing said "strike" zone panel away from said back panel and "ball" zone panel bias means for biasing said "ball" zone panel away from said back panel.

24. The trainer and game apparatus of claim 1, including catcher means for catching a ball upon its arrival at the target location, and ball return means for returning a ball from said catcher means to the person.

25. The trainer and game apparatus of claim 24, wherein said ball return means includes an elongated throwing arm having a proximal end and a distal end, said proximal end being pivotally mounted with said throwing arm biased toward a throwing position and being pivotally moveable against the bias toward a cocked position, cup means on the distal end of said arm for holding a ball that is to be thrown by the arm, cocking means for moving the arm against the bias to the cocked position, loading means for loading a ball into the cup means, release means for releasing the arm from the cocked position to allow the arm to pivot with the bias to propel the ball, and bumper means for stopping pivotal movement of the arm with the bias while allowing the ball to continue in a free flight trajectory.

26. Trainer and game apparatus of claim 25, wherein said cocking means includes a cam follower surface on said arm and camming means adjacent said arm for interacting with said cam follower surface to move said arm to the cocked position, said cam follower surface terminating at a slotted notch in said arm such that movement of said camming means off said cam follower surface releases said arm from the cocked position.

27. The trainer and game apparatus of claim 26, wherein said camming means includes a rotatable crank wheel positioned adjacent said arm and driven by a motor, and a cam pin protruding from the periphery of the crank wheel in the axial direction into the pivot path of the arm.

28. The training and game apparatus of claim 26, including lock means for locking the arm in the cocked position when a condition occurs where the arm is in the cocked position when the motor stops turning the crank wheel.

29. The trainer and game apparatus of claim 28, wherein said lock means includes a solenoid driven lock bolt that is positioned adjacent the cocked position of the arm and which is biased to jut axially over the arm when the motor stops driving the crank wheel.

30. The trainer and game apparatus of claim 25, wherein said loading means includes a pivotally mounted loading chute positioned adjacent said cup means when said arm is in cocked position, said loading chute comprising a pocket portion for holding a ball and normally upward inclined chute portion between the pocket portion and the cup means, an elongated finger extending longitudinally from the end of the upward inclined chute portion into the pivotal path of the distal end of the arm such that movement of the cup means to the cocked position pivots the upward inclined chute to slope downward toward the cup means and the pocket to move upward in relation to the cup means.

31. The trainer and game apparatus of claim 30, wherein said loading means includes magazine means for holding multiple balls in position to roll into the pocket.

32. The trainer and game apparatus of claim 31, including a spring attached to the pocket for biasing the loading chute to the normal pivotal position with the pocket down and the chute portion inclined upward, said spring being positioned to stretch between the magazine and the pocket to prevent a ball in the magazine from advancing when the loading chute is pivoted by said finger to raise the pocket and incline the chute portion downwardly.

33. The trainer and game apparatus of claim 30, including ball detector means for sensing presence of a ball in the pocket and sending a signal to the computer means indicating the presence of a ball in the pocket.

34. The trainer and game apparatus of claim 24, wherein said target means and said catcher means are pivotally connected to allow said target means and said catcher means to be folded together for transport and storage.

35. Trainer and game apparatus for use by a person practicing fielding by catching a propelled ball and throwing it toward said target means, comprising:

means for propelling a ball toward the person, said propelling means including start means for generating a start signal in response to the ball being propelled, said propelling means further including target means for generating a stop signal in response to arrival of the ball at a target location associated with the propelling means after the ball has been caught by the person and thrown to the target means;

computer means connected to said start means and to said target means and receptive of said start signal and said stop signal, and operative for measuring the time elapsed between the generation of the start signal and the generation of the stop signal; and reporting means connected to said computer means for reporting to the person information relating to the elapsed time; and wherein the person catches the propelled ball and throws the ball toward the target means, and wherein said computer means measures the time elapsed between the generation of the start signal and the generation of the stop signal to determine a fielding time for the person's catching and throwing of the ball.

36. The trainer and game apparatus of claim 35, wherein said ball return means includes an elongated throwing arm having a proximal end and a distal end, said proximal end being pivotally mounted with said throwing arm biased toward a throwing position and being pivotally moveable against the bias toward a cocked position, cup means on the distal end of said arm for holding a ball that is to be thrown by the arm, cocking means for moving the arm against the bias to the cocked position, loading means for loading a ball into the cup means, release means for releasing the arm from the cocked position to allow the arm to pivot with the bias to propel the ball, and bumper means for stopping pivotal movement of the arm with the bias while allowing the ball to continue in a free flight trajectory.

37. The trainer and game apparatus of claim 36, wherein said cocking means includes a cam follower surface on said arm and camming means adjacent said arm for interacting with said cam follower surface to move said arm to the cocked position, said cam follower surface terminating at a slotted notch in said arm such that movement of said camming means off said cam follower surface releases said arm from the cocked position.

38. The trainer and game apparatus of claim 37, wherein said camming means includes a rotatable crank wheel positioned adjacent said arm and driven by a motor, and a cam pin protruding from the periphery of the crank wheel in the axial direction into the pivot path of the arm.

39. The trainer and game apparatus of claim 38 wherein said start means includes a magnetic switch located on said ball return means adjacent said crank wheel and a magnet positioned on said crank wheel to be in alignment with said magnetic switch at the time when the ball is thrown from said ball return means.

40. The trainer and game apparatus of claim 37, including lock means for locking the arm in the cocked position when the arm is in the cocked position and the motor stops turning the crank wheel.

41. The trainer and game apparatus of claim 40, wherein said lock means includes a solenoid driven lock bolt that is positioned adjacent the cocked position of the arm and which is biased to jut axially over the arm when the motor stops driving the crank wheel.

42. The trainer and game apparatus of claim 36, wherein said loading means includes a pivotally mounted loading chute positioned adjacent said cup means when said arm is in cocked position, said loading chute comprising a pocket portion for holding a ball and normally upward inclined chute portion between the pocket portion and the cup means, an elongated finger extending longitudinally from the end of the upward inclined chute portion into the pivotal path of the distal end of the arm such that movement of the cup means to the cocked position pivots the upward inclined chute to slope downward toward the cup means and the pocket to move upward in relation to the cup means.

43. The trainer and game apparatus of claim 42, wherein said loading means includes magazine means for holding multiple balls in position to roll into the pocket.

44. The trainer and game apparatus of claim 43, including a spring attached to the pocket for biasing the loading chute to the normal pivotal position with the pocket down and the chute portion inclined upward, said spring being positioned to stretch between the magazine and the pocket to prevent a ball in the magazine from advancing when the loading chute is pivoted by said finger to raise the pocket and incline the chute portion downwardly.

45. The trainer and game apparatus of claim 42, including ball detector means for sensing presence of a ball in the pocket and sending a signal to the computer means indicating the presence of a ball in the pocket.

46. The trainer and game apparatus of claim 35, wherein said target means includes a "strike" zone panel surrounded by a "ball" zone panel, and also including "strike" signal means for causing said stop signal when the pitched ball impacts said "strike" zone panel and "ball" signal means for causing said stop signal when the pitched ball impacts said "ball" zone panel.

47. The trainer and game apparatus of claim 46, wherein said computer means is connected to both said "strike" signal means and said "ball" signal means to detect when said stop signal is caused by said "strike" signal means and to detect when said stop signal is caused by said "ball" signal means.

48. The trainer and game apparatus of claim 47, wherein said stop signal from said "strike" signal means causes the computer means to compare the fielding time to a threshold time, and record an "out" if the fielding time is less than the threshold time, and record a "run" if the fielding time is greater than or equal to the threshold time and said stop signal from said "ball" signal means causes the computer to record a "run."

49. The trainer and game apparatus of claim 48, wherein the threshold time is adjustable.

50. The trainer and game apparatus of claim 48, wherein the computer means tallies the recorded "outs" as total "outs" and tallies the recorded "runs" as total "runs"; and wherein said computer means causes said reporting means to report the total "outs" and to report the total "runs".

51. The trainer and game apparatus of claim 50, wherein said reporting means reports audibly to the person.

52. The trainer and game apparatus of claim 35, wherein said computer means compares the fielding time to a threshold time, and records an "out" if the fielding time is less than the threshold time, and records a "run" if the fielding time is greater than or equal to the threshold time.

53. The trainer and game apparatus of claim 52, wherein the threshold time is adjustable.

54. The trainer and game apparatus of claim 52, wherein the computer means tallies the recorded "outs" as total "outs" and tallies the recorded "runs" as total "runs"; and wherein said computer means causes said reporting means to report the total "outs" and to report the total "runs".

55. The trainer and game apparatus of claim 54, wherein said reporting means reports audibly to the person.

56. A method for practicing the throwing of a ball by a person toward a target, wherein the person practices throwing by pitching to the target from a predetermined distance, the method comprising the steps of:

starting an elapsed-time timer at the instant the ball is thrown by the person toward the target, wherein the starting the timer step includes sensing the shifting of the person's weight from his or her back foot to his or her front foot, the back foot corresponding to the throwing arm of the person and the front foot corresponding to the arm opposite from the throwing arm;

stopping the elapsed-time timer at the instant the ball hits the target;

calculating the elapsed time;

calculating an approximate speed of the pitched ball by dividing the distance by the elapsed time; and reporting to the person information relating to the elapsed time, including reporting the speed of the pitched ball.

57. A method for practicing the throwing of a ball by a person toward a target, wherein the person practices fielding by catching the ball and throwing the ball to the target, the method comprising the steps of:

starting an elapsed-time timer at the instant the ball is thrown by a ball return apparatus toward the person;

running the elapsed-time timer during the time the ball is traveling toward the person from the ball return apparatus, during the time the ball is being caught and thrown by the person, and during the time the ball is traveling toward the target after being thrown by the person;

stopping the elapsed-time timer at the instant the ball hits the target after the ball is thrown toward the target by the person;

calculating the elapsed time, wherein the elapsed time includes the time for the ball to travel from the ball return apparatus to the person, and the time for the person to catch the ball and throw the ball back to the target; and reporting information relating to the elapsed time to the person.

58. A method as defined in claim 57, wherein the reporting step includes reporting the elapsed time.

59. A method as defined in claim 57, including the additional step after the calculating step of:

comparing the elapsed time to a threshold time and recording an "out" if the elapsed time is less than the threshold time and recording a "run" if the elapsed time is greater than or equal to the threshold time; and wherein the reporting step includes reporting the result of the comparing step as all "out" or a "run".

* * * * *